US005157012A

United States Patent [19]

Mathiaparanam et al.

[11] Patent Number: 5,157,012

[45] Date of Patent: Oct. 20, 1992

[54] DI[BIS-(INDOLYL)ETHYLENYL]TETRAHALOPHTHALIDE RECORD MATERIALS

[75] Inventors: Ponnampalam Mathiaparanam, Appleton; Dean G. Dalebroux, Green Bay; Kenneth D. Glanz, Appleton, all of Wis.

[73] Assignee: Appleton Papers Inc., Appleton, Wis.

[21] Appl. No.: 557,284

[22] Filed: Jul. 24, 1990

Related U.S. Application Data

[63] Continuation-in-part of Ser. No. 397,703, Aug. 23, 1989, Pat. No. 4,970,308.

[51] Int. Cl.[5] ..... B41M 5/30

[52] U.S. Cl. ..... 503/209; 427/15; 503/208; 503/220; 503/221; 503/223

[58] Field of Search ..... 427/151; 503/208, 209, 503/220, 221, 223; 544/62, 80, 143, 144; 546/187, 201; 548/456

[56] References Cited

U.S. PATENT DOCUMENTS 4,730,057 3/1988 Kanda et al. ..... 548/524

FOREIGN PATENT DOCUMENTS 0242169 10/1987 European Pat. Off. ..... 503/220

*Primary Examiner*—Bruce H. Hess
*Attorney, Agent, or Firm*—Benjamin Mieliulis

[57] ABSTRACT

Pressure-sensitive and heat-sensitive record materials are described comprising a substrate, an acidic developer and chromogenic di-[bis-(indolyl) ethylenyl]tetrahalophthalides of the formula wherein $L^1 =$ and $L^2 =$ wherein each $X^1$, $S^2$, $X^3$, and $X^4$ is independently selected from chlorine or bromine;

wherein each of $R^1$ and $R^7$ is independently selected from cycloalkyl, aralkyl, alkoxyalkyl, or aroxyalkyl;

wherein each of $R^2$ and $R^8$ is independently selected from alkyl ($C_1$–$C_8$) or aryl (substituted or unsubstituted);

wherein each of $R^3$, $R^4$, $R^5$, $R^6$,$R^9$, $R^{10}$, $R^{11}$, and $R^{12}$ is independently selected from hydrogen alkyl ($C_1$–$C_8$), cycloalkyl, aryl (substituted or unsubstituted), halogen, alkoxy ($C_1$–$C_8$), aroxy, cycloalkoxy, dialkylamino including symmetrical and unsymmetrical alkyl ($C_1$–$C_8$), alkylcycloalkylamino, dicycloalkylamino, alkylarylamino,

37 Claims, 5 Drawing Sheets

DI[BIS-(INDOLYL)ETHYLENYL]TETRAHALOPHTHALIDE RECORD MATERIALS

This application is a continuation-in-part of Ser. No. 07/397/703, filed Aug. 23, 1989, now U.S. Pat. No. 4,970,308.

FIELD OF INVENTION

1. Background of Invention

This invention relates to record materials comprising chromogenic di-[bis(indolyl)ethylenyl]tetrahalophthalides. Record materials using these chromogenic compounds give intense colors when reacted with an electron accepting coreactant material. This invention relates to novel pressure-sensitive or heat-sensitive mark-forming record systems. As used in mark-forming systems, marking in desired areas on support webs or sheets may be accomplished by effecting localized reactive contact between the chromogenic material and the electron-accepting material on or in such web or sheet, such material being brought thereto by transfer or originally there in situ, the desired reactive contact forming colored images in the intended image marking areas.

2. Description of related Art

Sheldon Farber, U.S. Pat. No. 4,119,776 issued Oct. 10, 1978, described vinyl phthalide color formers. Several divinyl phthalide chromogenic compounds (C1) [(C) $L^1$, $L^2$=substituted phenyl] (read as Compound C1 arrived at by referring to formula C wherein $L^1$ and $L^2$ are as stated) have been prepared by the condensation of ethylenes (A1) [(A) $L^1$, $L^2$=substituted phenyl] with phthalic anhydrides (B) [(B) Each Halogen is independently Cl or Br] in acetic anhydride.

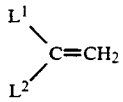
(A)

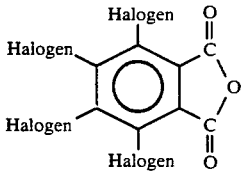
(B)

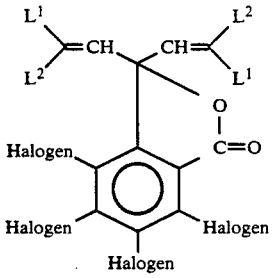
(C)

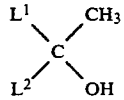
(D)

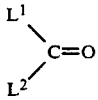
(E)

-continued

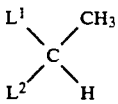
(F)

Substituted ethylenes (Al) or their precursors (D1) [(D) $L^1$,$L^2$=substituted phenyl] were prepared by the reaction of methylmagnesium bromide (also known as methyl Grignard reagent) with ketones (E1) [(E) $L^1$,$L^2$=substituted phenyl]. The use of Grignard reaction to prepare (A1) imposes severe restrictions on the scale up synthesis of (A1) and consequently on the manufacture of divinyl phthalides (C1).

In another synthetic approach, the alcohol (D1) was obtained by reacting the ethane (F1) [(F) $L^1$, $L^2$=substituted phenyl]with lead peroxide in either nitric acid or formic acid; and the substituted ethylene (A1) was obtained from (D1) by dehydration [Yamada Kagaku, Japan Kokai 1988-8360, filed Jun. 30, 1986].

When indole was heated with acetic anhydride containing 10% acetic acid a bis(indolyl)ethylene (A2) [(A) $L^1$, $L^2$=1-acetylindole-3-yl] was obtained as a by-product in 5–10% yield (J. E. Saxton, J. Chem. Soc., 3592 (1952)].

Substituted (2- and 1,2-) indoles when reacted with acetyl cyanide in the presence of hydrogen chloride yielded 1-cyano-1,1-di(3-indolyl)ethanes (G) and these products can be converted to bis(indolyl)ethylenes (H) by heating them under vacuum either alone or with soda lime. In some cases, depending on the substituents M and W, (G) yields (H) on refluxing with aqueous-ethanolic 10% potassium hydroxide [A. K. Kiang and F. G. Mann, J. Chem., Soc., 594 (1953)].

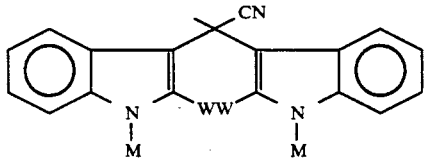
(G)

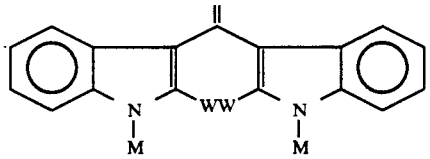
(H)

M = H, Ph
W = Me, Ph

Bis(indolyl)ethylene (H1) [(H) M=H and W=Me] was speculated to be a product (m.p. 203° C.) from the reaction of 2-methylindole with ethyl acetate and sodium ethoxide. No other data were given to substantiate the structure [A. Angeli and G. Marchetti, Atti. Accad. Lincei, 16 (II), 179 (1907)].

In another report (W. Borsche and H. Groth, Annalen, 549, 238 (1941)], 2-methylindole when boiled with acetyl chloride formed a product that on treatment with alkali gave a pseudobase, ($C_{20}H_{18}N_2$, pale rose, m.p. 208° C.). The pseudobase was suggested to be i-(2-methylindole-3-yl)-1-(2-methyl-3-indolidene)ethane (H2). Again, insufficient data precludes the substantiation of this structure. Furthermore, similar structure was proposed for the pseudobase obtained by substituting 2-phenylindole for 2-methylindole.

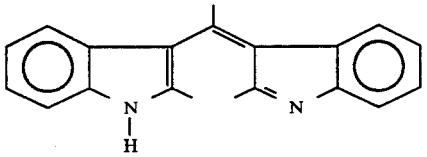

(H2)

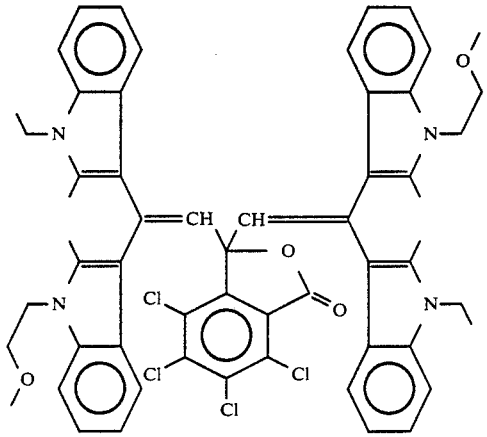

Figure 1:
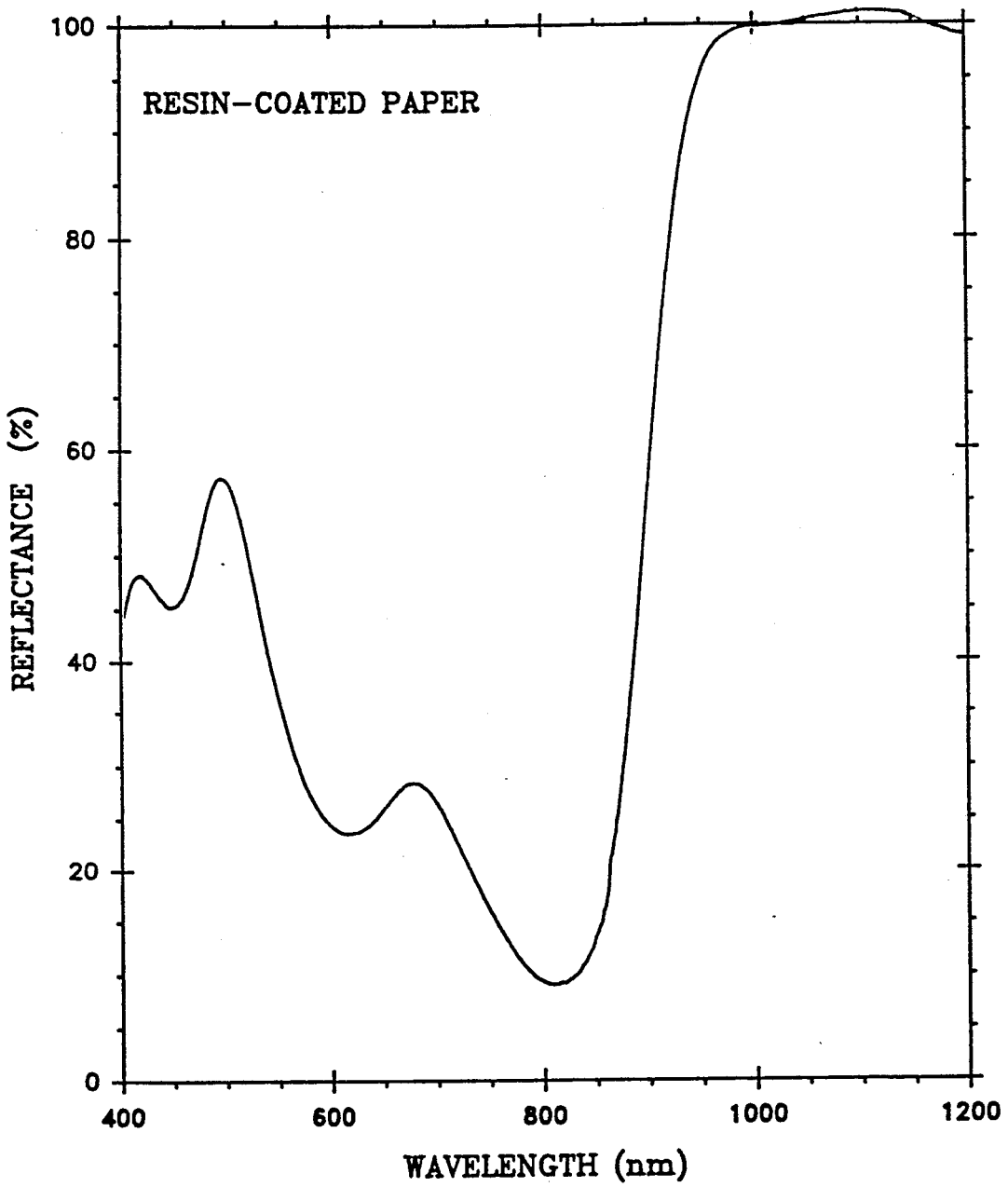
FIG. 1 is a graph of reflectance (%) from 400 to 1200 nm for the following compound when coated on resin-coated paper.
Figure 2:
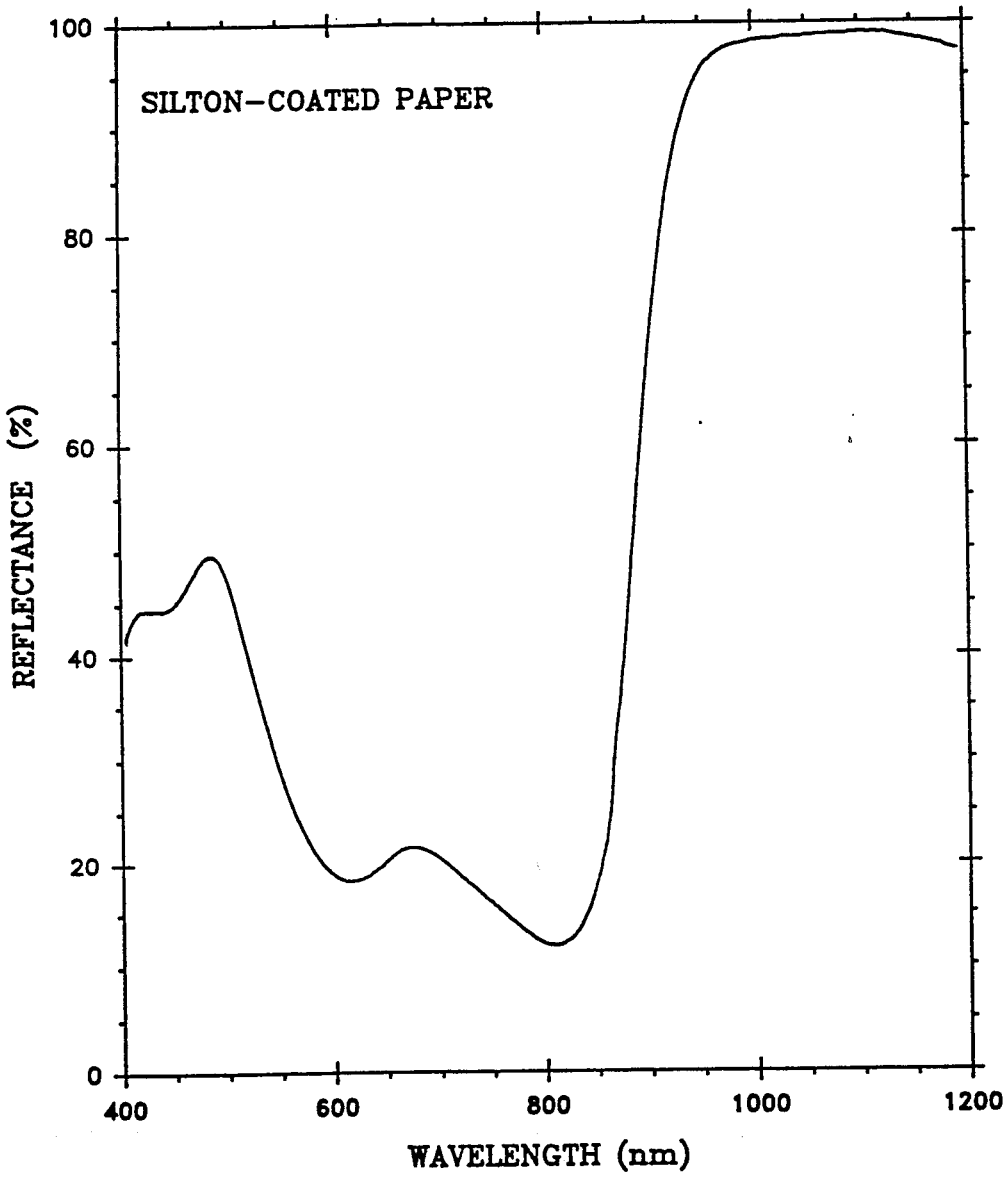

FIG. 2 is a graph of reflectance of the above compound when coated on silton-coated paper. Example 2 details the synthesis of this specific compound.

Figure 3:
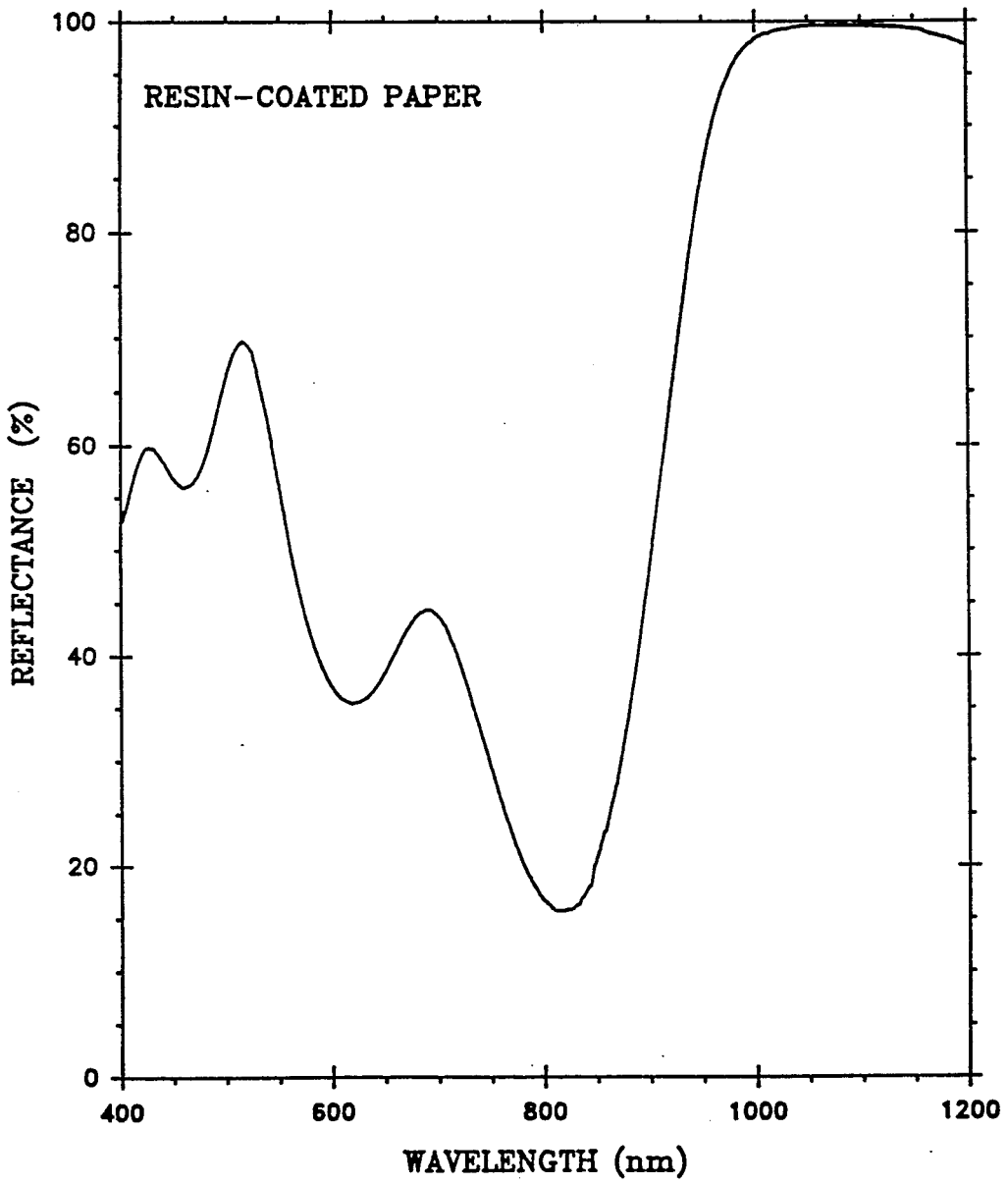

FIG. 3 is a graph of reflectance (%) from 400 to 1200 nm for the following compound when coated on resin-coated paper:

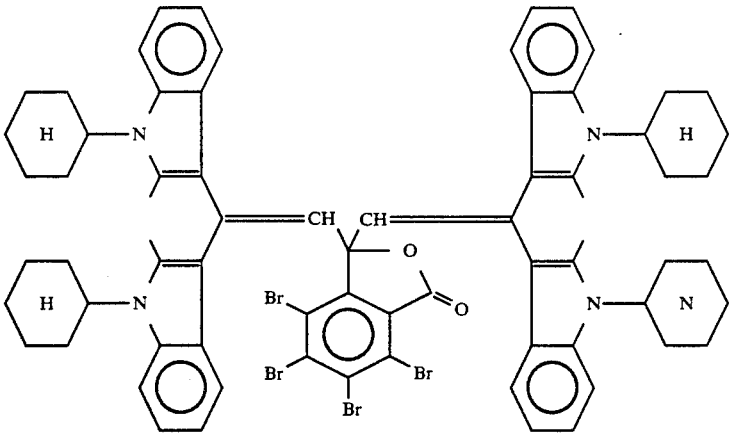

Figure 4:
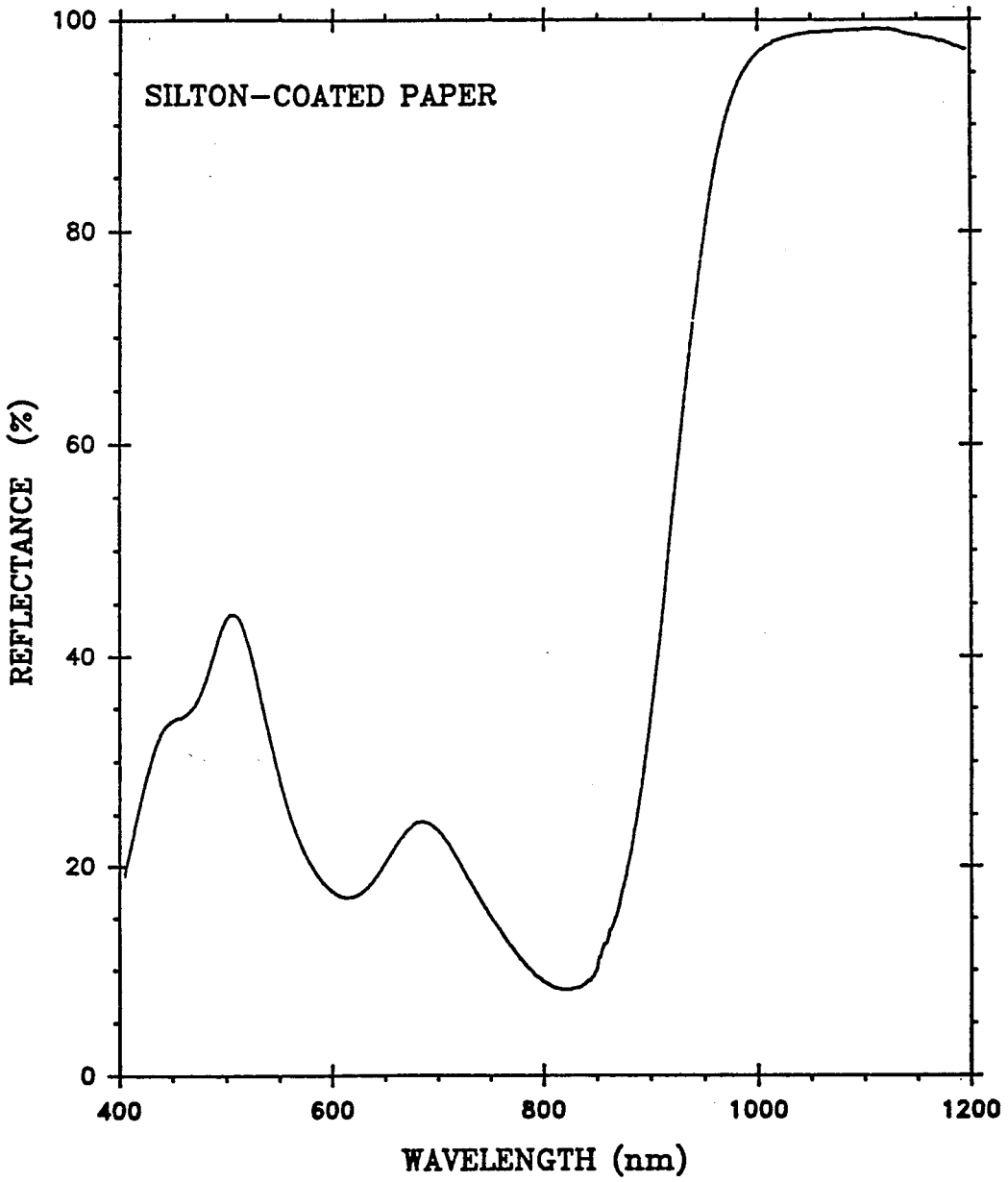

FIG. 4 is a graph of reflectance of the above compound when coated on silton-coated paper.

Figure 5:
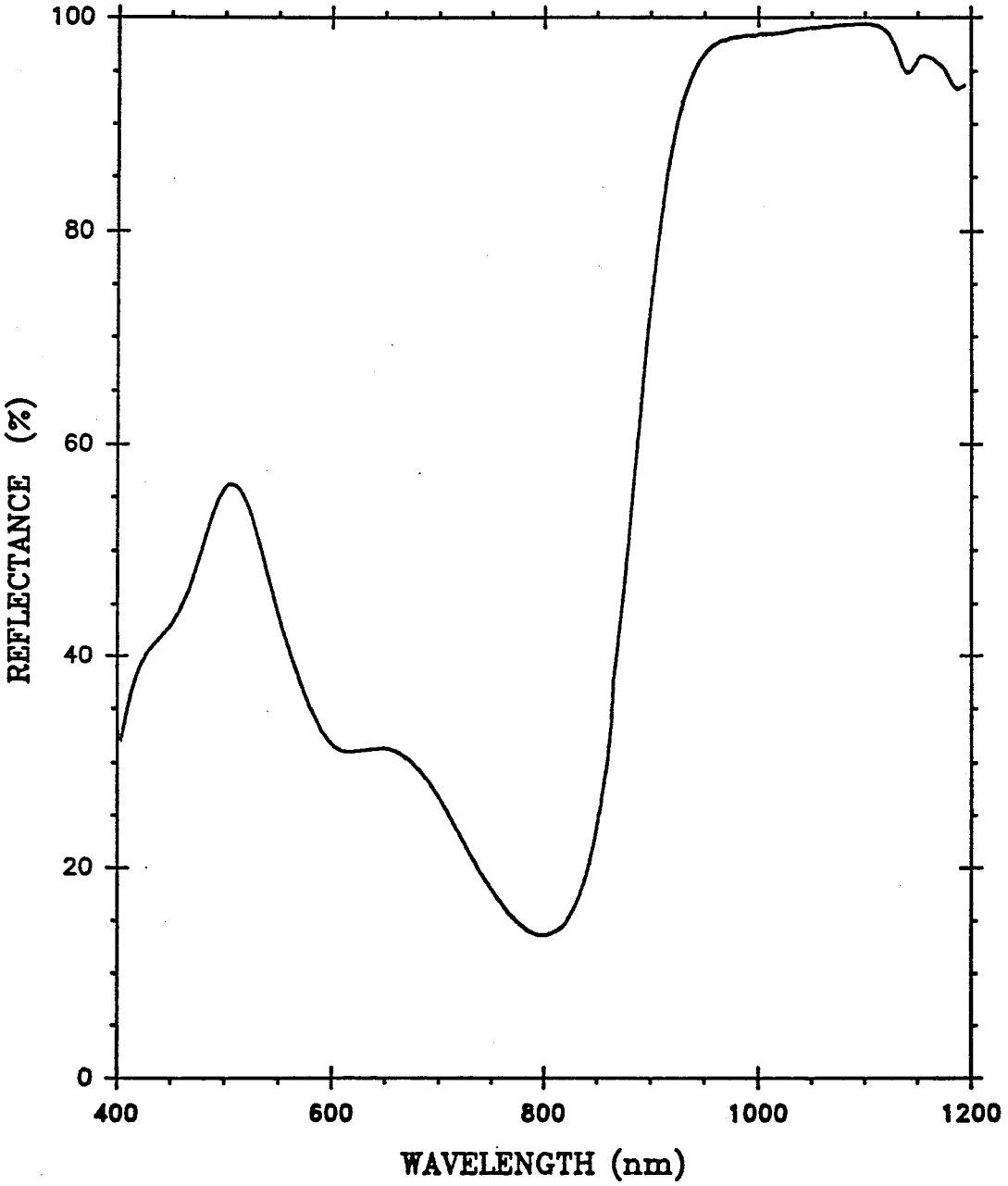

FIG. 5 is a graph of reflectance of the image, obtained in Example 15, illustrating a carbonless type transfer system using 3,3-bis[1,1-bis(5-cyclohexyl-1-ethyl-2-methylindole-3-yl) ethylene-2-yl]4,5,6,7-tetrachlorophthalide.

SUMMARY OF THE INVENTION

Novel record materials comprising symmetrical and unsymmetrical chromogenic di-[bis-(indolyl)ethylenyl]-tetrahalophthalides are disclosed. The record materials comprise a substrate a chromogenic di[bis-(indolyl)ethylenyl]tetrahalophthalide, and an acidic or electron-accepting developer. Specifically these compounds are chromogenic di-[bis-(indolyl)ethylenyl]tetrahalophthalides of the formula

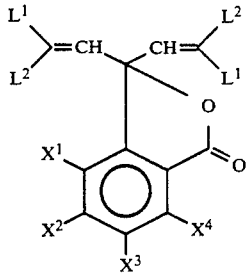

wherein

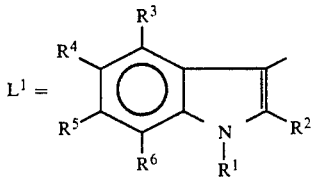

and

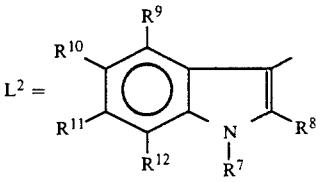

wherein each $X^1$, $X^2$, $X^3$, and $X^4$ is independently selected from chlorine or bromine;

wherein each of $R^1$ and $R^7$ is independently selected from cycloalkyl (e.g. cyclohexyl, cyclopentyl, cyclobutyl and cyclopropyl), aralkyl, alkoxyalkyl (e.g. $\beta$-methoxyethyl), aroxyalkyl (e.g. $\beta$-phenoxyethyl); wherein each of $R^2$ and $R^8$ is independently selected from alkyl ($C_1$–$C_8$) and aryl (substituted or unsubstituted);

wherein each of $R^3$, $R^4$, $R^5$, $R^6$, $R^9$, $R^{10}$, $R^{11}$, and $R^{12}$ is independently selected from hydrogen, halogen, alkyl ($C_1$–$C_8$), cycloalkyl, aryl (substituted or unsubstituted), halogen, alkoxy ($C_1$–$C_8$), aroxy, cycloalkoxy, dialkylamino including symmetrical and unsymmetrical alkyl ($C_1$–$C_8$), alkylcycloalkylamino, dicycloalkylamino, alkylarylamino,

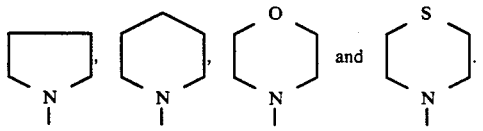

J1 = $L^1$ or $L^2$.

It should be understood herein that all alkyl moieties, such as alkyl, or alkyl as part of aralkyl or alkoxyalkyl are of one to eight carbons. Cycloalkyl groups are of three to six carbons.

Novel methods are disclosed for producing these di-[bis-(indolyl)ethylenyl]tetrahalophthalides. The above formula, for ease of reference, can also be expressed as (C2) [(C) wherein each Halogen is independently selected from chlorine or bromine; wherein each L namely, $L^1$ and $L^2$ is the same or different and is each independently selected from indole moieties (J1). This is read as new compound C2 arrived at by reference to formula C wherein $L^1$ and $L^2$ are as stated.

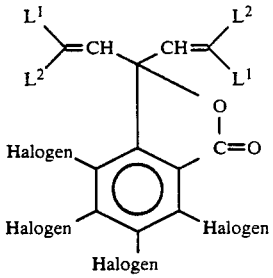

(C)

J1 = $L^1$ or $L^2$.

Preparation of di-[bis-(indolyl)ethylenyl]tetrahalophthalides (C2) comprises condensation of bis(indolyl)ethylenes (A3) [(A) wherein each $L^1$ and $L^2$ is the same or different and is each independently selected from indole moieties (J1), with tetrahalophthalic anhydrides (B) in acetic anhydride with or without acetate of Group I or Group II elements of the periodic table.

The first route uses the corresponding indoles, acetic anhydride and Lewis acid such as zinc chloride or other electron acceptor preferably in approximately 1:1:0.5 molar ratios respectively in a suitable solvent. The second route uses the corresponding indoles with acetyl chloride preferably in approximately 1:(0.5–2.0) molar amounts at temperatures (15°–75° C.) with or without solvent. The third route involves a condensation of component (K1) with indole (J1) in the presence of a Vilsmeier reagent (such as phosphoryl chloride, phosgene, oxalyl chloride, benzoyl chloride, alkanesulfonyl chloride, arenesulfonyl chloride, alkyl chloroformate and aryl chloroformate) with or without solvent. This third route can be used to conveniently prepare unsymmetrical indolyl ethylenes (i.e. (A3) with different $L^1$ and $L^2$).

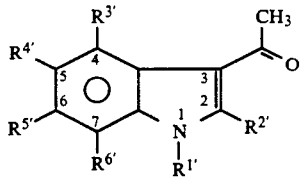

(K1)

wherein $R^{1'}$, $R^{2'}$, $R^{3'}$, $R^{4'}$, $R^{5'}$, $R^{6'}$ of K1 are defined identically as $R^1$, $R^2$, $R^3$, $R^4$, and $R^6$ respectively in formula $L^1$, i.e. $R^{1'}$ is defined the same as $R^1$, $R^{2'}$ is defined as $R^2$, $R^{3'}=R^3$, $R^{4'}=R^4$, $R^{5'}=R^5$ and $R^{6'}=R^6$.

The processes disclosed herein are versatile and can be used to prepared di[bis-(indolyl)ethylenyl]tetrahalophthalides using indoles with broader substitution patterns than simply J1, i.e., can be used to make compounds broader in scope than (C). In other words, if desired, in the disclosed processes, K1's substituents $R^{1'}$ and $R^{2'}$ can be broader than $R^1$ and/or $R^2$ of J1. Thus, $R^{1'}$ can additionally, in the disclosed processes, include hydrogen, alkyl ($C_1$–$C_8$), substituted or unsubstituted aryl, and alkoxy. $R^{2'}$ can additionally in the processes include hydrogen.

Solvents as referred to herein are preferably organic and more preferably the halogenated organic solvents such as 1,2-dichloroethane and chlorobenzene and the like.

Di-[bis-(indolyl)ethylenyl]tetrahalophthalides (C2) are prepared via two major routes from bis(indolyl)ethylenes (A3) and tetrahalophthalic anhydrides (B). In the first route bis(indolyl)ethylene (A3) and tetrahalophthalic anhydride (B) in 2:1 molar ratio respectively were heated at 100°–110° C. in acetic anhydride for 2–3 hours. In the case of acid sensitive bis(indolyl)ethylene, acetate of Group I or Group II elements was added to the above reaction mixture to improve the yield of (C2). In the second route, the bis(indolyl)ethylene (A3) is generated in situ from the indole (J1) and acetyl chloride with or without solvent and then condensed with tetrahalophthalic anhydride (B) in the presence of acetate of Group I or Group II elements and acetic anhydride at 100°–110° C. for 2–3 hours. This procedure, referred to as one-pot two-step synthesis, has several advantages over the first route; for example, (a) it simplifies the process for the manufacture of di-[bis(indolyl)ethylenyl]tetrahalophthalides (C2) by eliminating the isolation and purification of intermediate bis(indolyl)ethylenes; and (b) unstable or difficult to isolate bis(indolyl)ethylenes (A3) are condensed in situ with tetrahalophthalic anhydrides (B) to give (C2) that are difficult to prepare otherwise.

All the above-mentioned methods are conducive to scale-up and are used to prepare a variety of di-[bis(indolyl)ethylenyl]tetrahalophthalides (C2). Some examples are illustrated in Table 1.

TABLE 1
REFLECTANCE MINIMA AND COLOR OF 3,3-BIS(INDOLYLETHYLENYL)-4,5,6,7-TETRAHALOPHTHALIDES ON RESIN-COATED AND SILTON-COATED PAPERS.
| ENTRY | COMPOUND | M.P. (°C.) | REFLECTANCE MINIMA RESIN-COATED | (nm)* & COLOR ON SILTON-COATED |
|---|---|---|---|---|
| 1 | 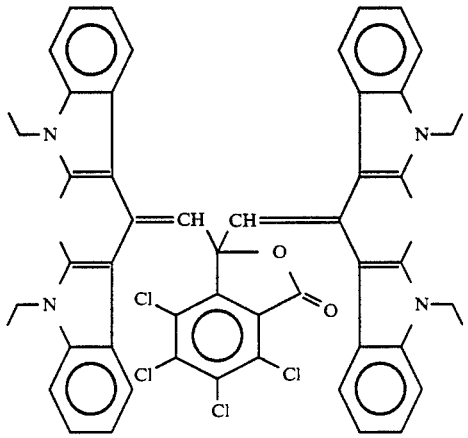 | 244–246 | 813 green | 806 blue |
| 2 | 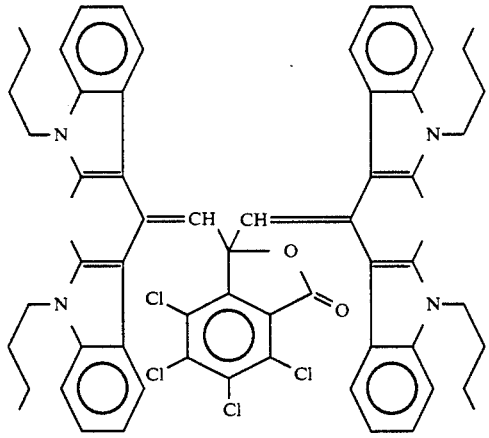 | 126–129 | 808 green | 806 blue |
| 3 | 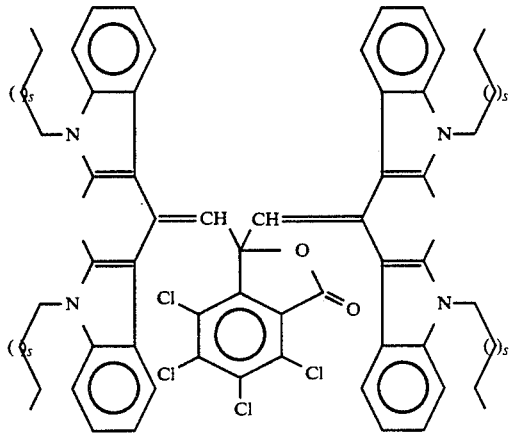 | 135–137 | 810 green | 804 blue |

TABLE 1-continued
REFLECTANCE MINIMA AND COLOR OF 3,3-BIS(INDOLYLETHYLENYL)-4,5,6,7-TETRAHALOPHTHALIDES ON RESIN-COATED AND SILTON-COATED PAPERS.
| ENTRY | COMPOUND | M.P. (°C.) | REFLECTANCE MINIMA RESIN-COATED | (nm)* & COLOR ON SILTON-COATED |
|---|---|---|---|---|
| 4 | 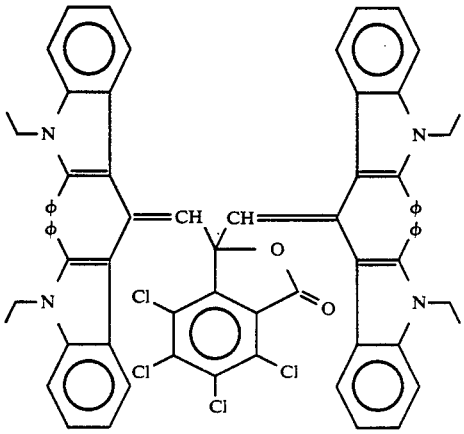 | 253–254 | 879 light green | 870 light green |
| 5 | 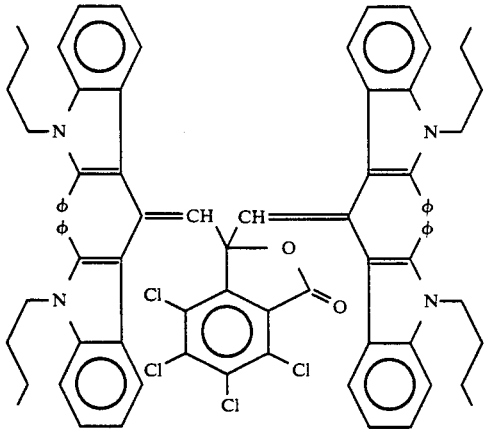 | 203–205 | 858 light green | 865 light green |
| 6 | 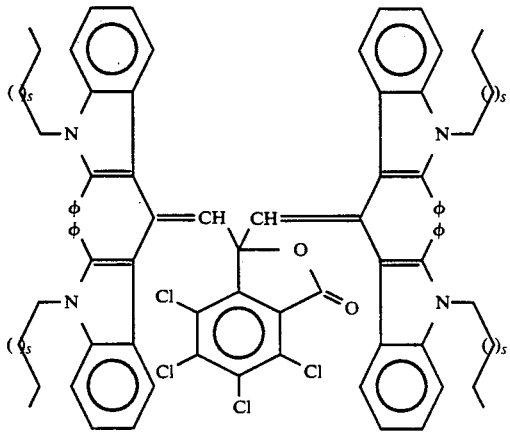 | 132–135 | 879 light green | 864 light green |

TABLE 1-continued
REFLECTANCE MINIMA AND COLOR OF 3,3-BIS(INDOLYLETHYLENYL)-4,5,6,7-TETRAHALOPHTHALIDES ON RESIN-COATED AND SILTON-COATED PAPERS.
| ENTRY | COMPOUND | M.P. (°C.) | REFLECTANCE MINIMA RESIN-COATED | (nm)* & COLOR ON SILTON-COATED |
|---|---|---|---|---|
| 7 | 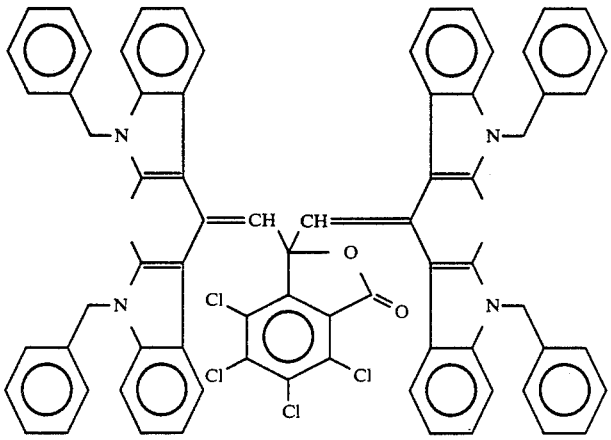 | 258–259 | 808 green | 809 green |
| 8 | 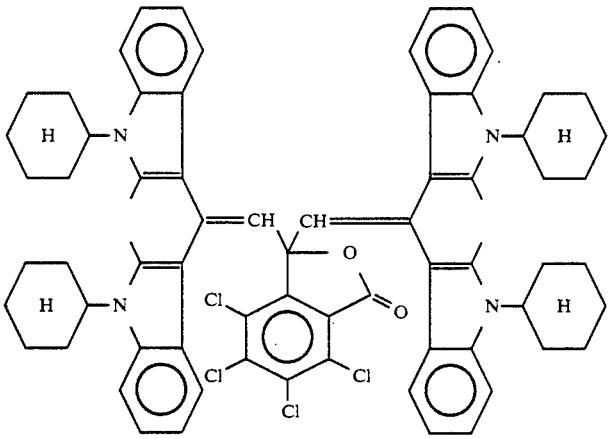 | 259–261 | 830 green | 830 green |
| 9 | 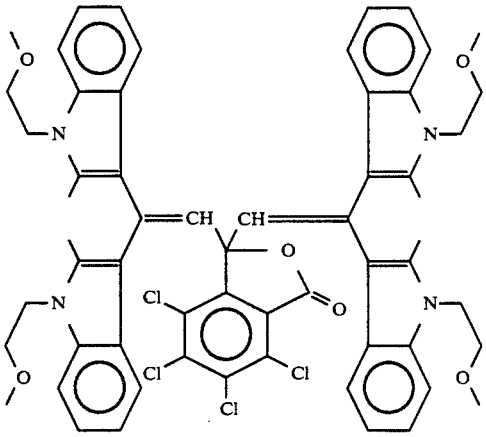 | 140–142 | 815 green | 808 bluish green |

TABLE 1-continued
REFLECTANCE MINIMA AND COLOR OF 3,3-BIS(INDOLYLETHYLENYL)-4,5,6,7-TETRAHALOPHTHALIDES ON RESIN-COATED AND SILTON-COATED PAPERS.
| ENTRY | COMPOUND | M.P. (°C.) | REFLECTANCE MINIMA RESIN-COATED | (nm)* & COLOR ON SILTON-COATED |
|---|---|---|---|---|
| 10 | 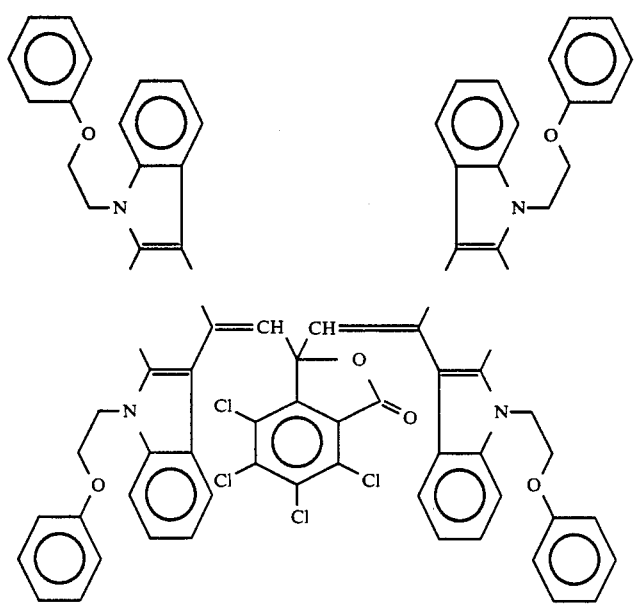 | 137–140 | 802 green | 822 green |
| 11 | 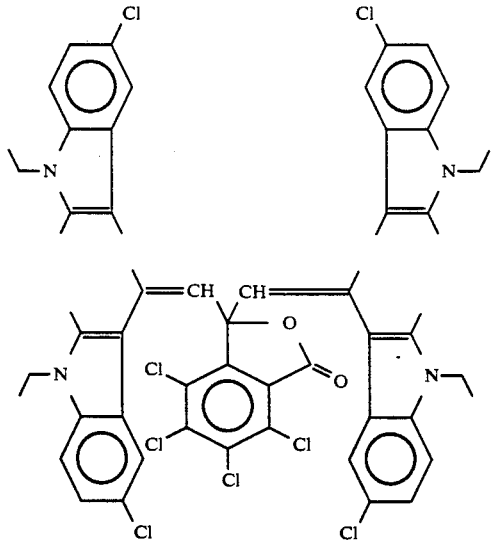 | 228–230 | 803 green | 799 blue |
| 12 | 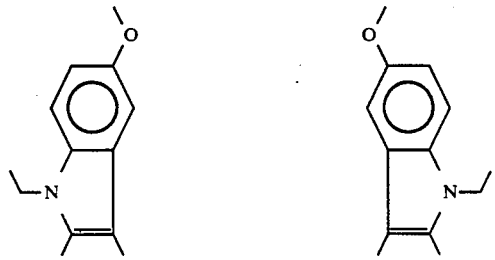 | 175–178 | 803 light blue | 794 blue |

TABLE 1-continued
REFLECTANCE MINIMA AND COLOR OF 3,3-BIS(INDOLYLETHYLENYL)-4,5,6,7-TETRAHALOPHTHALIDES ON RESIN-COATED AND SILTON-COATED PAPERS.
| ENTRY | COMPOUND | M.P. (°C.) | REFLECTANCE MINIMA RESIN-COATED | (nm)* & COLOR ON SILTON-COATED |
|---|---|---|---|---|
| | 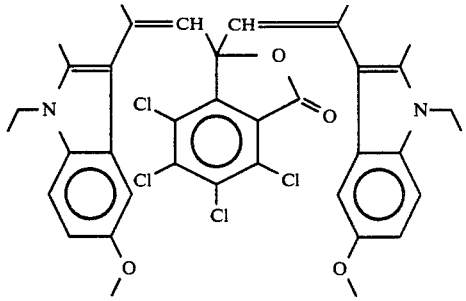 | | | |
| 13 | 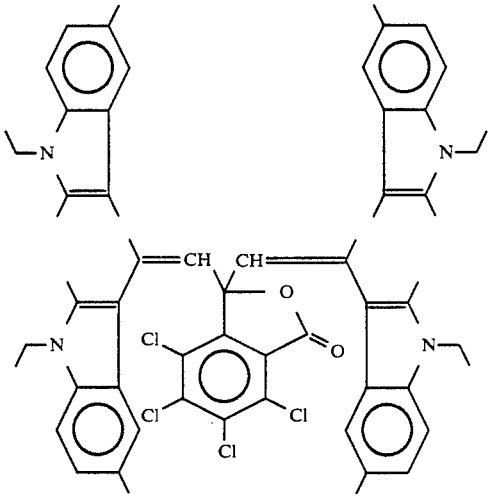 | 262–263 | 805 green | 812 blue |
| 14 | 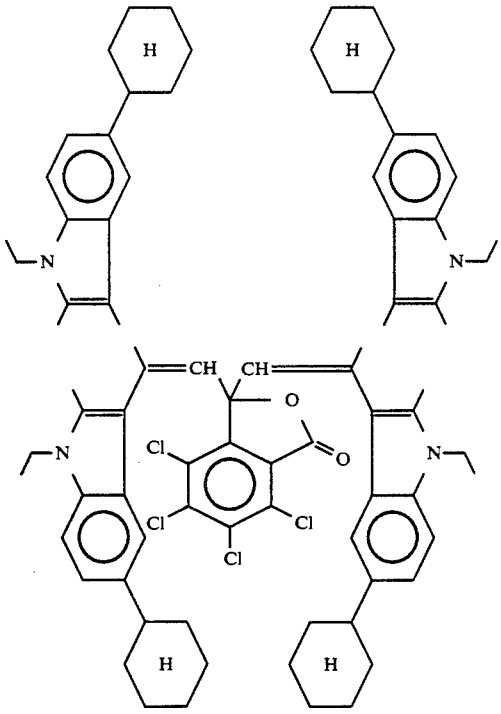 | 235–237 | 805 green | 808 bluish green |

TABLE 1-continued
REFLECTANCE MINIMA AND COLOR OF 3,3-BIS(INDOLYLETHYLENYL)-4,5,6,7-TETRAHALOPHTHALIDES ON RESIN-COATED AND SILTON-COATED PAPERS.
| ENTRY | COMPOUND | M.P. (°C.) | REFLECTANCE MINIMA RESIN-COATED | (nm)* & COLOR ON SILTON-COATED |
|---|---|---|---|---|
| 15 | 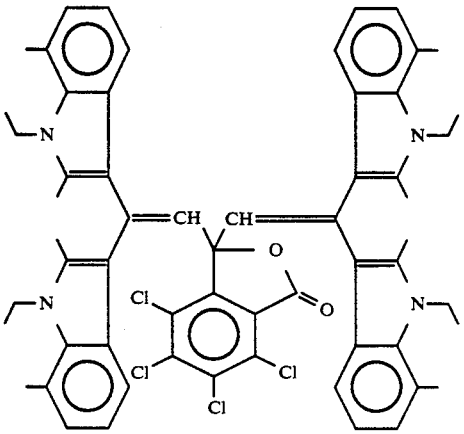 | 260–262 | 832 green | 827 bluish green |
| 16 | 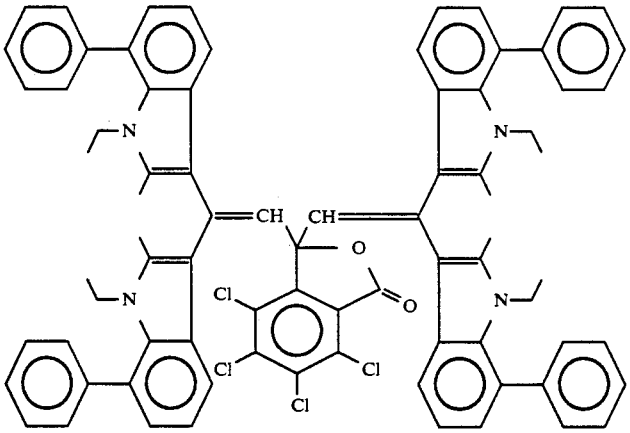 | 223–226 | 843 green | 832 bluish green |
| 17 | 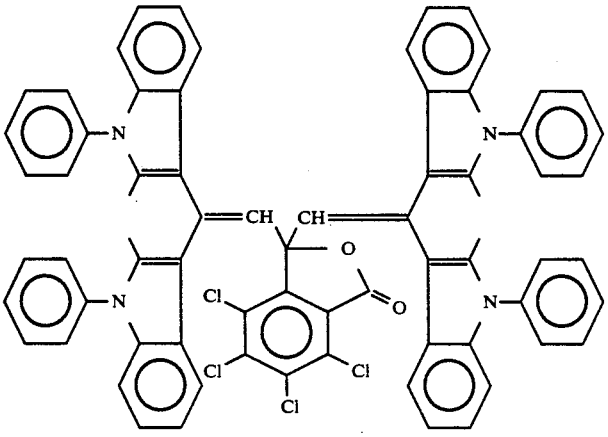 | 211–213 | 829 green | 818 green |

TABLE 1-continued
REFLECTANCE MINIMA AND COLOR OF 3,3-BIS(INDOLYLETHYLENYL)-4,5,6,7-TETRAHALOPHTHALIDES ON RESIN-COATED AND SILTON-COATED PAPERS.
| ENTRY | COMPOUND | M.P. (°C.) | REFLECTANCE MINIMA RESIN-COATED | (nm)* & COLOR ON SILTON-COATED |
|---|---|---|---|---|
| 18 | 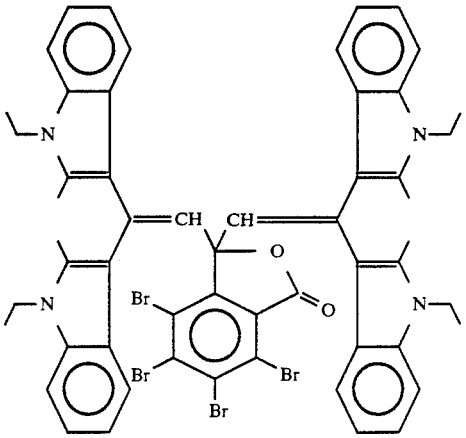 | 230–232 | 807 green | 805 blue |
| 19 | 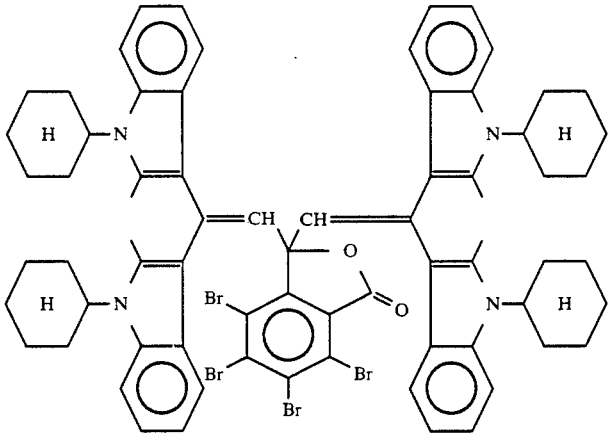 | 252–253 | 834 green | 829 green |
| 20 | 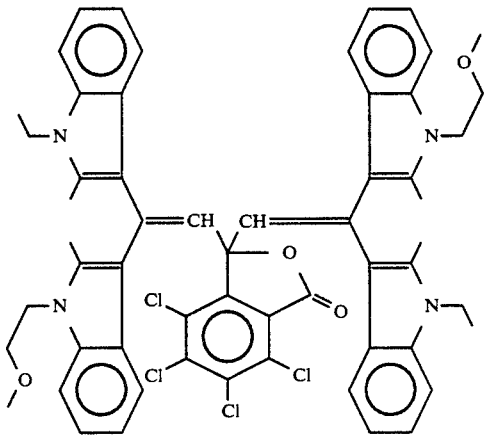 | 218–220 | 812 green | 805 bluish green |

TABLE 1-continued

REFLECTANCE MINIMA AND COLOR OF 3,3-BIS(INDOLYLETHYLENYL)-4,5,6,7-TETRAHALOPHTHALIDES ON RESIN-COATED AND SILTON-COATED PAPERS.

| ENTRY | COMPOUND | M.P. (°C.) | REFLECTANCE MINIMA RESIN-COATED | (nm)* & COLOR ON SILTON-COATED |
|---|---|---|---|---|
| 21 | 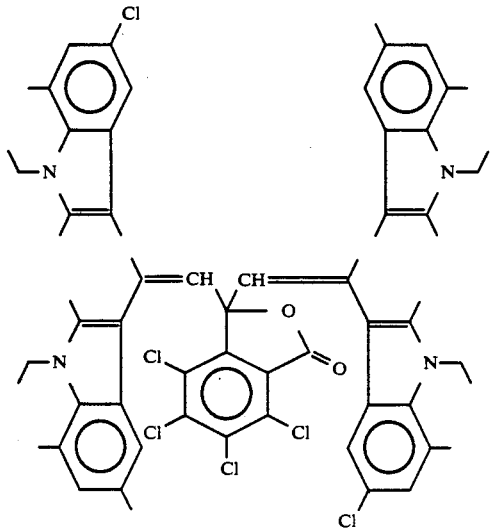 | 269–271 | 826 green | 826 green |
| 22 | 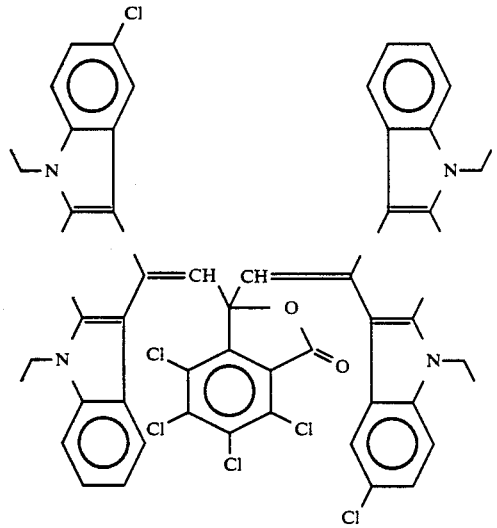 | 194–235 | 807 green | 803 blue |

*Near infrared region only

DETAILED DESCRIPTION

This invention teaches record systems with chromogenic compounds which in color form have absorbance in the infrared region of the spectrum at approximately 700–1200 nm. Thus these compounds are eligible for use in pressure-sensitive and thermal recording systems. Compounds which are chromogenic and absorptive in the near infrared region of the spectrum have commercial utility by being capable, when imaged, of being detected by optical reading machines.

More particularly, this invention describes novel methods for the preparation of substantially colorless but colorable chromogenic compounds eligible for use in pressure-sensitive recording and thermal recording systems. Advantageously recording systems utilizing these compounds can be read by optical reading machines, particularly those capable of reading for the infrared wavelength range of 700–1200 nm.

The colorable chromogenic compounds of the invention, can be combined with other chromogenic materials covering other or wider spectral ranges and can be used in pressure-sensitive and thermal recording systems to provide images which absorb over wider ranges of the electromagnetic spectrum. The commercial significance is that a larger assortment of available optical readers can thus be effectively useful with such imaged record systems.

Mixtures of the phthalides of this invention can be assembled. Mixtures of these chromogens which are grey, black or neutral can be useful in record systems, including carbonless and thermal systems. In thermal systems such mixtures have been suggested as reducing background. Such mixtures can be assembled using the compounds of this invention or in combination with other chromogens such as fluoran chromogens. Colorless chromogens such as the fluorans, useful in combination with the phthalide chromogens disclosed herein, are disclosed in many patents such as U.S. Pat. No. 3,525,630; 3,540,909; 3,540,911; 3,746,562; 3,940,275; Reissue 23,024; and 4,027,065 incorporated herein by reference.

The chromogenic compounds of the invention also find use in photosensitive printing material, typewriter ribbons, inks and the like.

More specifically the process of the invention relates to the preparation of chromogenic compounds having two vinyl linkages. These compounds are substantially colorless or slightly colored solids but can be converted to colored forms upon reactive contact with an electron accepting material. The compounds of the invention in imaged or colored form are typically dark colored and are remarkably absorptive of near infrared light such that images formed of these compounds can be detected by conventional optical readers capable of detecting in the infrared wavelength range of 700–1200 nm.

In the invention di-[bis(indolyl)ethylenyl]tetrahalophthalides (C2) [(C) wherein each halogen is independently selected from chlorine or bromine; wherein each L namely, $L^1$ and $L^2$ is the same or different and is each independently selected from indole moieties of the formulae (J1)] are prepared. (C2) is understood or read to be compound (C) as described in the brackets and with reference to the formula set forth below.

The processes described for the preparation of (C2) are very conducive to scale up.

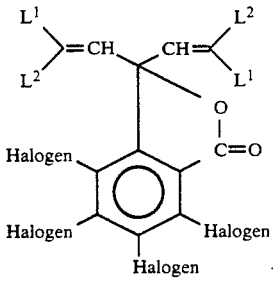

(C)

J1 = $L^1$ or $L^2$ are as earlier defined herein. The halogen is each independently chlorine or bromine.

In forming pressure-sensitive or heat-sensitive mark-forming record systems with di-[bis(indolyl)ethylenyl]-tetrahalophthalides of the invention, the eligible acidic, or electron acceptor materials include, but are not limited to, acid clay substances such as attapulgite, bentonite and montmorillonite and treated clays such as silton clay as disclosed in U.S. Pat. Nos. 3,622,364 and 3,753,761, phenols and diphenols as disclosed in U.S. Pat. No. 3,539,375, aromatic carboxylic acids such as salicylic acid, metal salts of aromatic carboxylic acids as disclosed in U.S. Pat. No. 4,022,936 and acidic polymeric material such as phenolformaldehyde polymers as disclosed in U.S. Pat. No. 3,672,935 and oil-soluble metal salts of phenolformaldehyde polymers as disclosed in U.S. Pat. No. 3,732,120. The compounds of this invention are useful as color formers in recording materials such as, for example, pressure-sensitive copying paper, thermally-responsive record material, electro heat-sensitive recording paper and thermal ink.

Pressure-sensitive copying paper systems provide a marking system and can be assembled by disposing on and/or within sheet support material unreacted mark-forming components and a liquid solvent in which one or both of the mark-forming components is soluble, said liquid solvent being present in such form that it is maintained isolated by a pressure-rupturable barrier from at least one of the mark-forming components until application of pressure causes a breach of the barrier in the area delineated by the pressure pattern. The mark-forming components are thereby brought into reactive contact, producing a distinctive mark. Typically in carbonless record systems microcapsules containing the chromogenic compound are positioned on a CB sheet and acidic developer is placed in juxtaposition on a CF sheet. Such transfer systems are disclosed in U.S. Pat. No. 2,730,456 incorporated herein by reference. For clarity, all patent numbers recited in this specification are to be understood as incorporating the disclosure of said patent(s) herein by specific reference.

The pressure-rupturable barrier, which maintains the mark-forming components in isolation, preferably comprises microcapsules containing liquid solvent solution. The microencapsulation process utilized can be chosen from the many known in the art. Well known methods are disclosed in U.S. Pat. Nos. 2,800,457; 3,041,289: 3,533,958; 3,755,190; 4,001,140 and 4,100,103. Any of these and other methods are suitable for encapsulating the liquid solvent containing the chromogenic compounds of this invention.

The chromogenic compounds of this invention are particularly useful in pressure-sensitive copying paper systems which incorporate a marking liquid comprising a vehicle in which is dissolved a complement of several colorless chromogenic compounds each exhibiting its own distinctive color on reaction with an eligible acidic material. Such marking liquids are disclosed in U.S. Pat. No. 3,525,630.

Thermally-responsive record material systems provide a marking system of color forming components which relies upon melting or subliming one or more of the components to achieve reactive, color-producing contact. The record material includes a substrate or support material which is generally in sheet form. Components of the color-forming system are in a substantially contiguous relationship, preferably substantially homogeneously distributed throughout a coated layer or layers of material deposited on the substrate. In manufacturing the record material, a coating composition is preferred which includes a fine dispersion of the components of the color-forming system, polymeric binder material, surface active agents and other additives in an aqueous coating medium.

The chromogenic compounds of this invention are useful in thermally-responsive record material systems either as single chromogenic compounds or in mixtures with other chromogenic compounds. Examples of such systems are given in U.S. Pat. Nos. 3,539,375 and 4,181,771.

Thermally-responsive record material systems are well known in the art and are described in many patents, for example U.S. Pat. Nos. 3,539,375; 3,674,535; 3,746,675; 4,151,748; 4,181,771; and 4,246,318 which are hereby incorporated by reference. In these systems, basic chromogenic material and acidic color developer material are contained in a coating on a substrate which, when heated to a suitable temperature, melts or softens to permit said materials to react, thereby producing a colored mark.

In the field of thermally-responsive record material, thermal sensitivity (response) is defined as the temperature at which a thermally responsive record material produces a colored image of satisfactory intensity (density). Background is defined as the amount of coloration of a thermally-responsive record material before imaging and/or in the unimaged areas of an imaged material. The ability to maintain the thermal sensitivity of a thermally-responsive record material while reducing the background coloration is a much sought after and very valuable feature.

One of the uses for thermally responsive record material which is enjoying increasing importance is facsimile reproduction. Alternative terms for facsimile are telecopying and remote copying. In the facsimile system, images transmitted electronically are reproduced as hard copy. One of the important requirements for thermally-responsive record material to be used in facsimile equipment is that it have good (low coloration) background properties.

Increases in the sensitivity of thermally-responsive record material have been achieved through the incorporation of a phenylhydroxynaphthoate compound or a hydroxyanilide compound in the color-forming composition along with the chromogenic material and developer material as disclosed in U.S. Pat. No. 4,470,057 or U.S. Pat. No. 4,535,347, respectively, by Kenneth D. Glanz. Such sensitizer materials can be advantageously used in combination with the present invention.

The record material includes a substrate or support material which is generally in sheet form. For purposes of this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

Although not required to practice and demonstrate the beneficial properties of the claimed invention, the inclusion of certain sensitizing materials in the color-forming system provides a further improvement in properties, especially increases in sensitivity. Materials such as 1,2-diphenoxyethane, N-acetoacetyl-o-toluidine, para-benzylbiphenyl; phenyl-1-hydroxy-2-naphthoate, stearamide and p-hydroxyoctadecanilide are useful as such sensitizing materials. A listing of additional sensitizers can be found in U.S. Pat. No. 4,531,140.

The components of the color-forming system are in a contiguous relationship, substantially homogeneously distributed throughout the color-forming system, preferably in the form of a coated layer deposited on the substrate. In manufacturing the record material, a coating composition is preferred which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as carnauba wax; synthetic waxes; lubricants such as zinc stearate; wetting agents and defoamers.

The color-forming system components are substantially insoluble in the dispersion vehicle (preferably water) and are ground to an individual average particle size of between about 1 micron to about 10 microns, preferably about 1 to about 3 microns. The polymeric binder material is substantially vehicle soluble, although latexes are also eligible in some instances. Preferred water-soluble binders include polyvinyl alcohol, hydroxyethylcellulose, methylcellulose, hydroxypropylmethylcellulose, starch, modified starches, gelatin and the like. Eligible latex materials include polyacrylates, polyvinylacetates, polystyrene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

DESCRIPTION OF THE PREFERRED EMBODIMENTS

In the following examples, general procedures for preparing certain di-[bis(indolyl)ethylenyl]tetrahalophthalides of formula (C2) are described; and the examples are not intended to be exhaustive and the moieties, as previously defined, are all eligible for use in any combination in preparing the compounds. Unless otherwise noted, all measurements, percentages and parts are by weight and in the metric system.

Satisfactory spectroscopic data were obtained for new compounds synthesized.

EXAMPLE 1

One-pot two-step preparation of 3.3-bis[1,1-bis(1-β-methoxyethyl-2-methylindole-3-yl) ethylene-2-yl]-4,5,6,7-tetrachlorophthalide

[Table 1, Entry 9]

1-β-methoxyethyl-2-methylindole (19.0 g, 0.1 mole) was stirred with acetyl chloride (16.0 g.0.2 mole) at room temperature for 5 hours. Sodium acetate (16.4 g,0.2 mole), acetic anhydride (30 ml) and tetrachlorophthalic anhydride (7.2 g,0.025 mole) were added to the reaction mixture and the reaction mixture was heated at 100° C. for two hours, cooled to room temperature, stirred with excess aqueous sodium hydroxide (10%) and toluene. After stirring for 30 minutes at 60° C., toluene layer was separated, washed twice with hot water, dried and concentrated. The residue was warmed with isopropanol and filtered. The product was purified by column chromatography on silica gel, followed by recrystallization from chloroform/isopropanol. Yield: 11.3 g(43%), pale yellow solid, m.p.: 140°-142° C.

A solution of the product gives a greenish blue color to paper coated with a phenolic resin, with reflectance minima at 607 and 815 nm; and a blue color to paper coated with silton clay, with reflectance minima at 610 and 808 nm.

The calculated analysis for $C_{60}H_{58}N_4O_6Cl_4$, the title compound, is C,67.16%; H,5.45%; N,5.22%; and Cl,13.22%. Found on analysis: C,67.17%; H,5.44%; N,5.10%; and Cl,13.19%.

EXAMPLE 2

Preparation of 3,3-bis[1-(1-ethyl-2-methylindole-3-yl)-1-(1-β-methoxyethyl-2-methylindole-3-yl)ethylene-2-yl]-4,5,6,7-tetrachlorophthalide

[Table 1, Entry 20)

1-(1-ethyl-2-methylindole-3-yl)-1-(1-β-methoxyethyl-2-methylindole-3-yl) ethylene (3.7 g,0.01 mole) and tetrachlorophthalic anhydride(1.5 g,0.005 mole) in acetic anhydride(15 ml) were heated at 120° C. for two hours, cooled down to room temperature and treated with aqueous sodium hydroxide(100 ml,10%) and toluene (100 ml). After vigorous stirring for 30 minutes, the toluene layer was separated, washed with hot water, dried and concentrated under reduced pressure. The residue was purified by chromatography on silica gel. The product obtained was heated with methanol, allowed to cool to room temperature and filtered; and, this process was repeated twice. Yield: 2.6 g(51%), brown powder, m.p.: 213°-217° C.

A solution of the product gives a green color to paper coated with a phenolic resin, with reflectance minima at 612 and 808 nm; and bluish green color to paper coated with silton clay, with reflectance minima at 609 and 809 nm.

The calculated analysis for $C_{58}H_{54}N_4Cl_4$, the title compound, is C,68.77%; H,5.37%; N,5.53%; and Cl,14.00%. Found on analysis: C,68.44%; H,5.15%; N,5.30%; and Cl,14.61%.

EXAMPLE 3

Preparation of 3.3-Bis[1-(1-ethyl-2-methylindole-3-yl)-1-(1-β-methoxyethyl-2-methylindole-3-yl)ethylene-2-yl]-4,5,6,7-tetrachloroohthalide using 1,2-dichloroethane as solvent

[Table 1, Entry 20]

1-(1-Ethyl-2-methylindole-3-yl)-1-(1-β-methoxyethyl-2-methylindole-3-yl) ethylene(14.9 g,0.04 mole) and tetrachlorophthalic anhydride(5.7 g,0.02 mole) in acetic anhydride(20 ml) and 1,2-dichloroethane(20 ml) were heated at 85° C. for 4 hours, cooled down to room temperature and treated with aqueous sodium hydroxide (200 ml, 10%) and toluene (500 ml). After vigorous stirring for 30 minutes, the toluene layer was separated, washed with hot water, dried and concentrated under reduced pressure. The residue was chromatographed on silica gel using first toluene and then toluene:acetone::4:1 as eluents. Fractions containing the product were collected, combined and concentrated. The residue was heated in methanol and allowed to cool. The solid formed was filtered and recrystallized from toluene/methanol. Yield:-17.2 g(85%), pale yellow solid, m.p.: 218°-220° C.

A solution of the product gives a green color to paper coated with a phenolic resin, with reflectance minima at 613 and 812 nm; and bluish green color to paper coated with silton clay, with reflectance minima at 613 and 805 nm.

The calculated analysis for $C_{58}H_{54}N_4O_4Cl_4$, the title compound, is C,68.77%; H,5.37%; N,5.53%; and Cl,14.00%. Found on analysis: C, 69.22%; H,5.40%; N,5.56%; and Cl,14.10%.

EXAMPLE 4

Thermal Record Material

| | Parts |
|---|---|
| Dispersion A - Chromogenic Material | |
| Chromogenic Material | 17.0 |
| Binder, 20% Solution of Polyvinyl Alcohol (Vinol 205) in Water | 14.5 |
| Defoaming and Dispersing Agents | 0.1 |
| Water | 68.4 |
| Dispersion A-3 - Chromogenic Material is IE-16 | |
| 3,3-Bis[1,1-bis(5-cyclohexyl-1-ethyl-2-methylindole-3-yl)ethylene-2-yl]-4,5,6,7-tetrachlorophthalide | |
| Dispersion A-4 - Chromogenic Materials is IE-22 | |
| 3,3-Bis[1-(1-ethyl-2-methylindole-3-yl)-1-(1-β-methoxyethyl-2-methylindole-3-yl)ethylene-2-yl]-4,5,6,7-tetrachlorophthalide | |
| Dispersion A-5 - Chromogenic Material is IE-4, | |
| 3,3-Bis[1,1-bis(1-β-methoxyethyl-2-methylindole-3-yl) ethylene-2-yl]-4,5,6,7-tetracholorphthalide | |
| Dispersion B - Chromogenic Material | |
| Chromogenic Material | 8.5 |
| Binder, 20% Solution of Polyvinyl Alcohol (Vinol 205) in Water | 7.2 |
| Defoaming and Dispersing Agents | 0.1 |
| Water | 84.2 |
| Dispersion B-3 - Chromogenic Material is IE-4, | |
| 3,3-Bis[1,1-bis(1-β-methoxyethyl-2-methylindole-3-yl)ethylene-2-yl]-4,5,6,7-tetrachlorophthalide | |
| Dispersion B-6 - Chromogenic Material is IE-15 | |
| 3,3-Bis[1,1-bis(1-cyclohexyl-2-methylindole-3-yl)ethylene-2-yl]-4,5,6,7-tetrachlorophthalide | |
| Dispersion B-7 - Chromogenic Material is IE-17 | |
| 3,3-Bis[1,1-bis(1-cyclohexyl-2-methylindole-3-yl)ethylene-2-yl]-4,5,6,7-tetrabromophthalide | |
| Dispersion B-8 - Chromogenic Material is IE-18 | |
| 3,3-Bis[1,1-bis(1-benzyl-2-methylindole-3-yl) ethylene-2-yl]-4,5,6,7-tetrachlorophthalide | |
| Dispersion B-9 - Chromogenic Material is IE-19 | |
| 3,3-Bis[1,1-bis(2-methyl-1-β-phenoxyethylindole-3-yl)ethylene-2-yl]-4,5,6,7-tetrachlorophthalide | |
| Dispersion B-10 - Chromogenic Material is IE-20 | |
| 3,3-Bis[1-(5-chloro-1-ethyl-2-methylindole-3-yl)-1-(1-ethyl-2-methylindole-3-yl)ethylene-2-yl]-4,5,6,7-tetrachlorophthalide | |
| Dispersion B-11 - Chromogenic Material is IE-21 | |
| 3,3-Bis[1-(5-chloro-2,7-dimethyl-1-ethylindole-3-yl)-1-(1-ethyl-2,5,7-trimethylindole-3-yl)ethylene-2-yl]-4,5,6,7-tetrachlorophthalide | |
| Dispersion C - Chromogenic Material | |
| Chromogenic Material | 31.6 |
| Binder, 20% Solution of Polyvinyl Alcohol (Vinol 205) in Water | 27.0 |
| Defoaming and Dispersing Agent | 0.5 |
| Water | 40.9 |
| Dispersion C-1 - Chromogenic Material is N-102, | |
| 3-Diethylamino-6-methyl-7-anilinofluoran | |
| Dispersion C-2 - Chromogenic Material is TH-107, | |
| 3-Di-n-butylamino-7-(2-chloroanilino)fluoran | |
| Dispersion D - Acidic Material | |
| Acidic Material | 29.8 |
| Binder, 20% Solution of Polyvinyl Alcohol (Vinol 205) in Water | 25.4 |
| Defoaming and Dispersing Agents | 0.2 |
| Water | 44.6 |
| Dispersion D-1 - Acidic Material is AP-5, | |
| 2,2-Bis(4-hydroxyphenyl)-4-methylpentane | |
| Dispersion D-2 - Acidic Material is Bisphenol A, | |
| 2,2-Bis(4-hydroxyphenyl)propane | |
| Dispersion D-3 - Acidic Material is TG-S, | |
| Bis(4-hydroxy-3-allylphenyl)sulfone | |

-continued

| | Parts |
|---|---|
| Dispersion E - Zinc Modified Acidic Material | |
| Zinc Modified Acidic Material | 29.8 |
| Binder, 20% Solution of Polyvinyl Alcohol (Vinol 205) in Water | 25.4 |
| Defoaming and Dispersing Agents | 0.2 |
| Water | 44.6 |
| Dispersion E-1 - Zinc Modified Acidic Material is Zinc salt of p-chlorobenzoic acid | |
| Dispersion E-2 - Zinc Modified Acidic Material is Zinc salt of trans cinnamic acid | |
| Dispersion F - Sensitizing Material | |
| Sensitizing Material | 29.8 |
| Binder, 20% Solution of Polyvinyl Alcohol (Vinol 205) in Water | 25.4 |
| Defoaming and Dispersing Agents | 0.2 |
| Water | 44.6 |
| Dispersion F-1 - Sensitizing Material is DPE, 1,2-Diphenoxyethane | |
| Dispersion F-2 - Sensitizing Material is p-Benzylbiphenyl | |

Water soluble polymers other than polyvinyl alcohol may be used in preparation of the dispersions.

The chromogenic, acidic, and sensitizing materials listed are illustrative and not intended to be limiting.

Coating Formulation I

| | |
|---|---|
| Dispersion B (Chromogenic) | 7.1 |
| Dispersion D (Acidic) | 6.7 |
| Dispersion E-1 (Acidic) | 6.7 |
| Dispersion F (Sensitizer) | 13.5 |
| Zinc Stearate (23.3% Solids Emulsion) | 5.1 |
| Filler | 6.2 |
| Binder, 10% Solution of Polyvinyl Alcohol in Water | 25.3 |
| Water | 29.4 |

Record Material with IE-4

Coating Formulation I Using
Dispersion B-3 (IE-4)
Dispersion D-1 (AP-5)
Dispersion F-1 (DPE)

TABLE 2

Reflectance Data - Stepwedge

| Temperature °F. | Percent Reflectance at 830 nm Example with IE-4 |
|---|---|
| 300 | 8 |
| 275 | 8 |
| 260 | 8 |
| 245 | 8 |
| 230 | 8 |
| 215 | 8 |
| 200 | 8 |
| 185 | 22 |
| 170 | 88 |
| 155 | 100 |

EXAMPLE 5

Coating Formulation II using:
Dispersion B-6 (IE-15)
Dispersion D-1 (AP-5)
Dispersion F-1 (DPE)

EXAMPLE 6

Coating Formulation I using:
Dispersion A-3 (IE-16)
Dispersion D-1 (AP-5)
Dispersion F-1 (DPE)

EXAMPLE 7

Coating Formulation II using:
Dispersion B-7 (IE-17)
Dispersion D-1 (AP-5)
Dispersion F-1 (DPE)

EXAMPLE 8

Coating Formulation II using:
Dispersion B-8 (IE-18)
Dispersion D-1 (AP-5)
Dispersion F-1 (DPE)

EXAMPLE 9

Coating Formulation II using:
Dispersion B-9 (IE-19)
Dispersion D-1 (AP-5)
Dispersion F-1 (DPE)

EXAMPLE 10

Coating Formulation II using:
Dispersion B-10 (IE-20)
Dispersion D-1 (AP-5)
Dispersion F-1 (DPE)

EXAMPLE 11

Coating Formulation II using:
Dispersion B-11 (IE-21)
Dispersion D-1 (AP-5)
Dispersion F-1 (DPE)

EXAMPLE 12

Coating Formulation I using:
Dispersion A-4 (IE-22)
Dispersion D-1 (AP-5)
Dispersion F-1 (DPE)

EXAMPLE 13

Preferred Embodiment

Coating Formulation III using:
Dispersion A-4 (IE-22)
Dispersion C-2 (TH-107)
Dispersion D-1 (AP-5)
Dispersion F-1 (DPE)

EXAMPLE 14

Preferred Embodiment

Coating Formulation III using:
Dispersion A-5 (IE-4)
Dispersion C-2 (TH-107)
Dispersion D-1 (AP-5)
Dispersion F-1 (DPE)

Reflectance data for Examples 5–14 is set forth in Table 3.

EXAMPLE 15

Carbonless Record System

IE-16 was dissolved in SS-290 (a carbonless internal phase solvent such as alkylated biphenyl solvent of Koch Chemical Company, Wichita, Kans.) resulting in a 1% IE-16/SS-290 solution. Two to three drops of this solution were then applied to a commercial grade CF resin-containing receiving sheet. The SS-290 was allowed to dissipate and the resulting image was read using the Perkin Elmer Lambda 9 UV/VIS/NIR Spectrophotometer. The Reflectance Spectra of FIG. 5 was obtained.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

-continued and $L^2 =$ 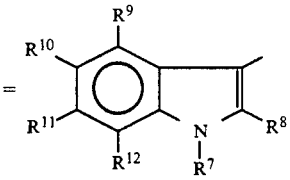

TABLE 3

| Temperature (°F.) | Example 5 IE-15 | Example 6 IE-16 | Example 7 IE-17 | Example 8 IE-18 | Example 9 IE-19 | Example 10 IE-20 |
|---|---|---|---|---|---|---|
| 300 | 8 | 8 | 10 | 7 | 6 | 7 |
| 275 | 8 | 8 | 11 | 7 | 6 | 7 |
| 260 | 8 | 8 | 12 | 8 | 6 | 7 |
| 245 | 9 | 9 | 13 | 9 | 7 | 8 |
| 230 | 11 | 11 | 14 | 10 | 7 | 9 |
| 215 | 12 | 12 | 15 | 11 | 8 | 10 |
| 200 | 14 | 14 | 17 | 13 | 9 | 11 |
| 185 | 62 | 58 | 66 | 61 | 31 | 49 |
| 170 | 98 | 96 | 99 | 99 | 91 | 98 |
| 155 | — | — | — | — | — | — |

| Temperature (°F.) | Example 11 IE-21 | Example 12 IE-22 | Example 13 (IE-22/TH-107) | Example 14 (IE-4/TH-107) |
|---|---|---|---|---|
| 300 | 8 | 4 | 5 | 5 |
| 275 | 8 | 5 | 5 | 5 |
| 260 | 8 | 5 | 5 | 6 |
| 245 | 9 | 5 | 5 | 7 |
| 230 | 10 | 5 | 6 | 9 |
| 215 | 11 | 6 | 6 | 11 |
| 200 | 13 | 6 | 11 | 27 |
| 185 | 56 | 14 | 48 | 83 |
| 170 | 98 | 80 | 96 | 100 |
| 155 | — | — | 99 | 100 |

Percent reflectance at 830 nm using Perkin Elmer Lambda-9, UV/VIS/NIR Spectrophotometer. (A lower number indicates a higher image intensity.)

What is claimed is:

1. A record material comprising a substrate, an acidic developer material and a chromogenic di-[bis(indolyl) ethylenyl]tetrahalophthalide of the formula

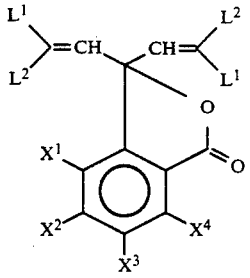

wherein $L^1 =$ 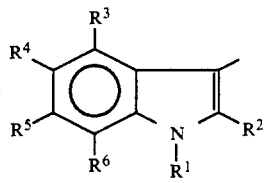

wherein each $X^1$, $X^2$, $X^3$ and $X^4$ is independently selected from chlorine or bromine;

wherein each of $R^1$ and $R^7$ is independently selected from cycloalkyl ($C_3$–$C_6$), aralkyl, alkoxyalkyl, or aroxyalkyl;

wherein each of $R^2$ and $R^8$ is independently selected from alkyl ($C_1$–$C_8$) or, aryl;

wherein each of $R^3$, $R^4$, $R^5$, $R^6$, $R^9$, $R^{10}$, $R^{11}$, and $R^{12}$ is independently selected from hydrogen, alkyl ($C_1$–$C_8$), cycloalkyl, aryl, halogen, alkoxy ($C_1$–$C_8$), aroxy, cycloalkoxy ($C_3$–$C_6$), dialkylamino including symmetrical and unsymmetrical alkyl ($C_1$–$C_8$), alkylcycloalkylamino, dicycloalkylamino, alkylarylamino,

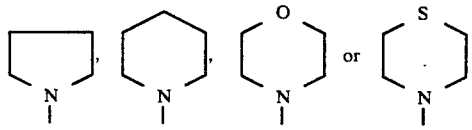

wherein each alkyl moiety referred to herein is from one to eight carbons, each cycloalkyl moiety referred to herein is three to six carbons.

2. The record material according to claim 1 wherein the di-[bis-(indolyl)ethylenyl]tetrahalophthalide is

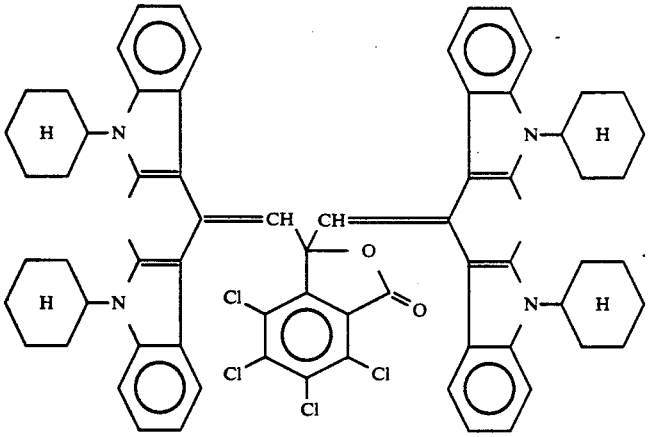

3. The record material according to claim 1 wherein the di-[bis-(indolyl)ethylenyl]tetrahalophthalide is

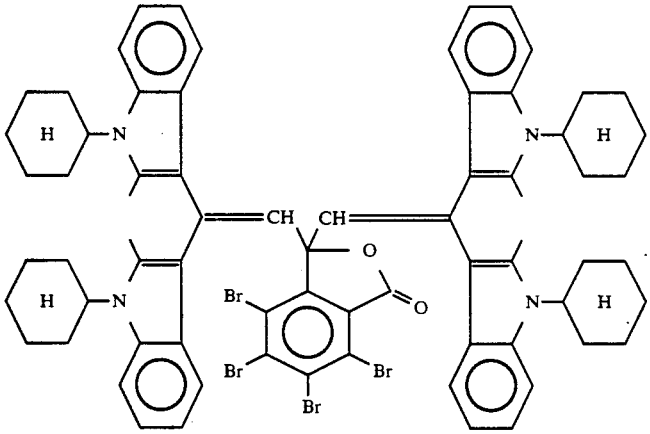

4. The record material according to claim 1 wherein the di-[bis-(indolyl)ethylenyl]tetrahalophthalide is

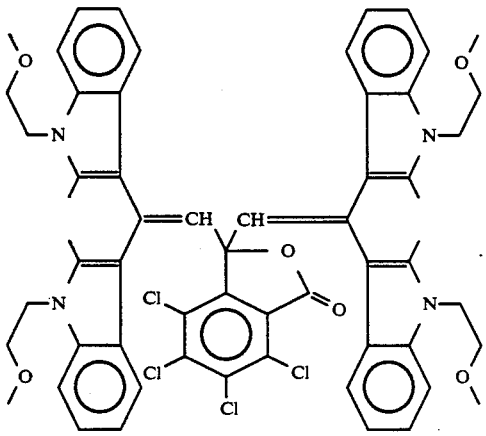

5. The record material according to claim 1 wherein the di-[bis-(indolyl)ethylenyl]tetrahalophthalide is

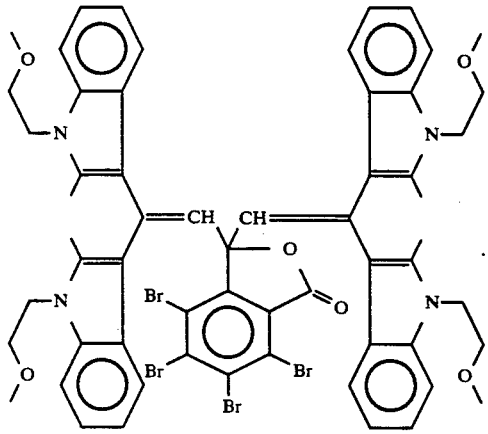

6. The record material according to claim 1 wherein the di-[bis-(indolyl)ethylenyl]tetrahalophthalide is

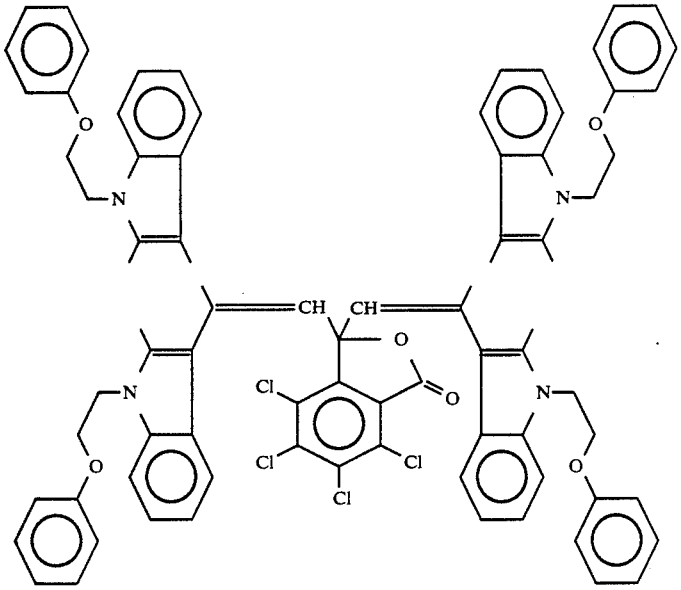

7. The record material according to claim 1 wherein the di-[bis-(indolyl)ethylenyl]tetrahalophthalide is

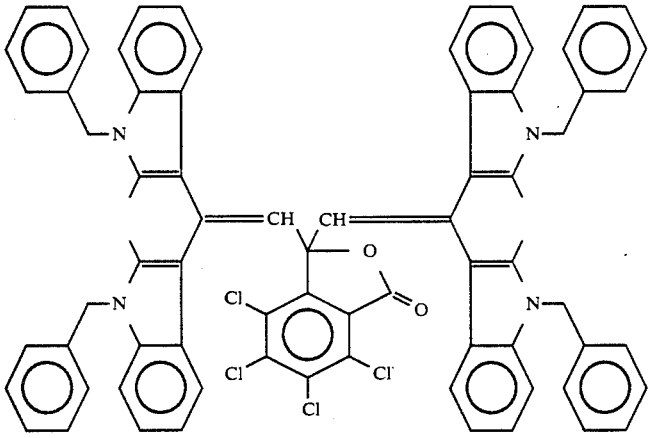

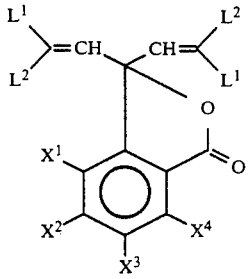

8. The record material according to claim 1 wherein the chromogenic di-[bis(indolyl)ethylenyl]tetrahalophthalide is selected such that each of $R^2$, and $R^8$ is alkyl and each of $R^3$, $R^4$, $R^5$, $R^6$, $R^9$, $R^{10}$, $R^{11}$, and $R^{12}$ is hydrogen.

9. A record material according to claim 1 which is pressure sensitive.

10. A record material according to claim 1 which is heat sensitive.

11. A record material comprising a substrate, an acidic developer material and a chromogenic di-[bis(indolyl)ethylenyl]tetrahalophthalide of the formula wherein $L^1 =$ 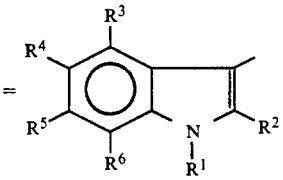

and

-continued

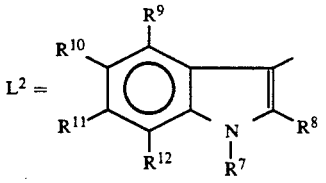

wherein each $X^1$, $X^2$, $X^3$ and $X^4$ is independently selected from chlorine or bromine;

wherein at least one of $R^3$, $R^4$, $R^5$, $R^6$, $R^9$, $R^{10}$, $R^{11}$, and $R^{12}$ is cycloalkyl ($C_3$–$C_6$), alkylarylamino,

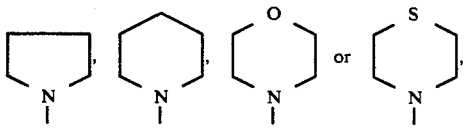

the balance of $R^3$, $R^4$, $R^5$, $R^6$, $R^9$, $R^{10}$, $R^{11}$, and $R^{12}$ is independently selected from hydrogen, alkyl ($C_1$–$C_8$), cycloalkyl, aryl, halogen, alkoxy ($C_1$–$C_8$), aroxy, cycloalkoxy, dialkylamino having symmetrical and unsymmetrical alkyl ($C_1$–$C_8$), alkylcycloalkylamino, dicycloalkylamino, or alkylarylamino, wherein each of $R^1$, $R^2$, $R^7$ and $R^8$ is independently selected from alkyl ($C_1$–$C_8$) or aryl, the alkyl moieties referred to herein being of from one to eight carbons, the cycloalkyl moieties referred to herein being of three to six carbons.

12. The record material according to claim 11 wherein the di-[bis-(indolyl)ethylenyl]tetrahalophthalide is

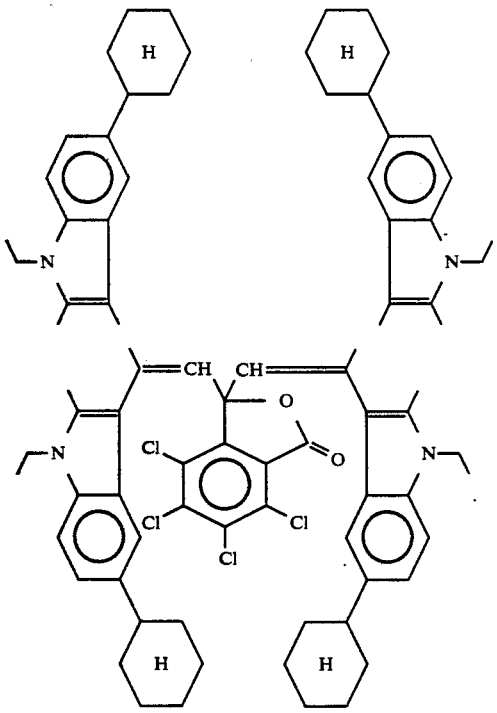

13. The record material according to claim 11 wherein the di-[bis-(indolyl)ethylenyl]tetrahalophthalide is

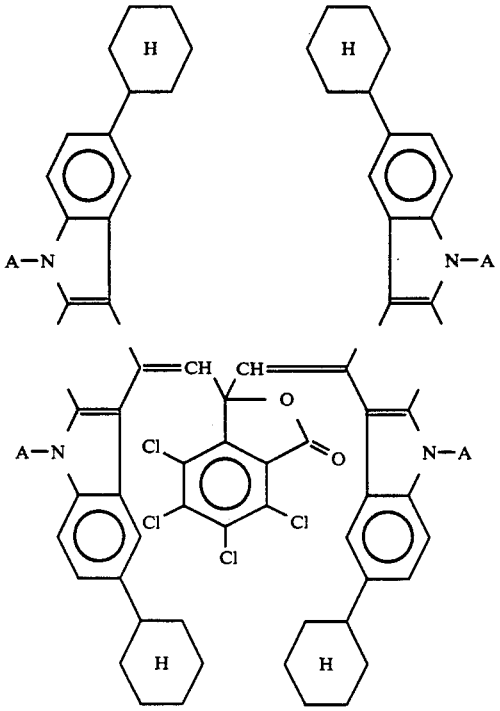

wherein A is $C_1$–$C_8$ alkyl.

14. The record material according to claim 11 wherein the di-[bis-(indolyl)ethylenyl]tetrahalophthalide is

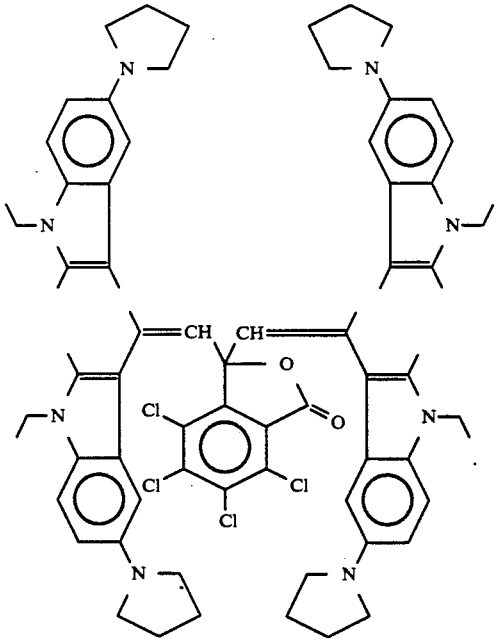

15. The record material according to claim 11 wherein the di-[bis-(indolyl)ethylenyl]tetrahalophthalide is

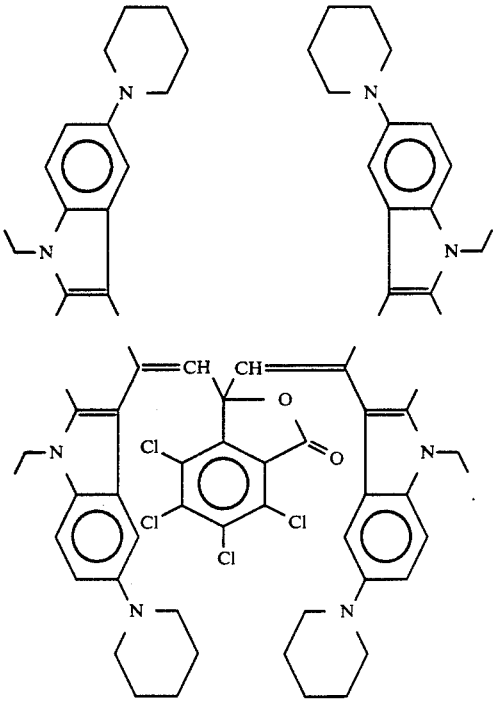

16. The record material according to claim 11 wherein the di-[bis-(indolyl)ethylenyl]tetrahalophthalide is

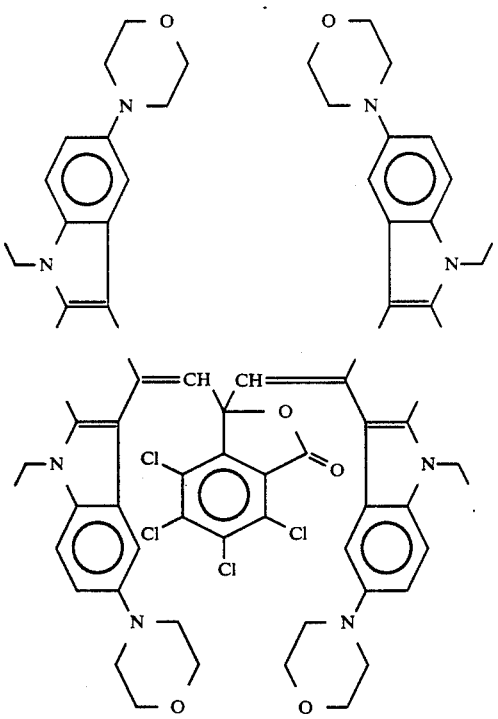

17. The record material according to claim 11 wherein the di-[bis-(indolyl)ethylenyl]tetrahalophthalide is

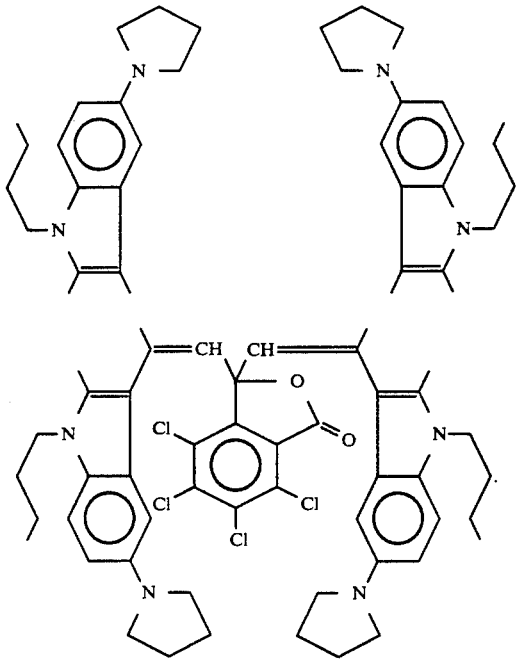

18. The record material according to claim 11 wherein the di-[bis-(indolyl)ethylenyl]tetrahalophthalide is

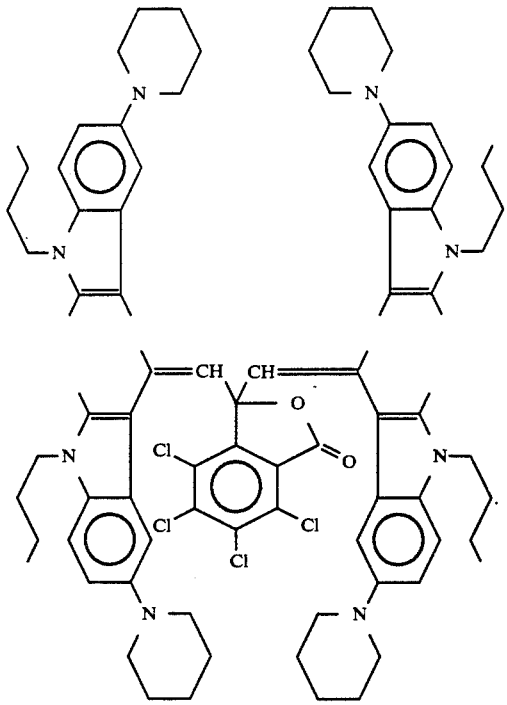

19. The record material according to claim 11 wherein the di-[bis-(indolyl)ethylenyl]tetrahalophthalide is

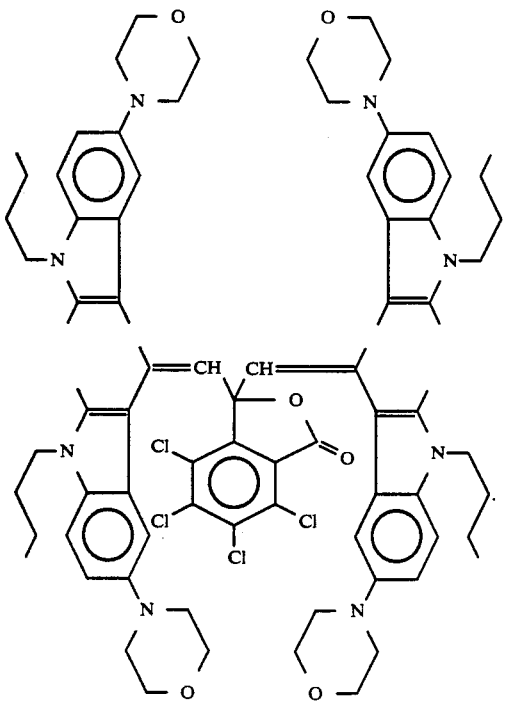

20. A record material comprising a substrate, an acidic developer material and an unsymmetrical chromogenic di-[bis-(indolyl)ethylenyl]tetrahalophthalide of the formula

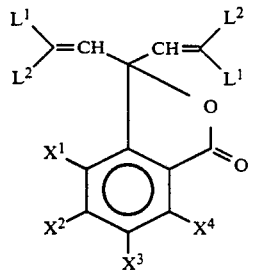

wherein indole moieties $L^1$ and $L^2$ are

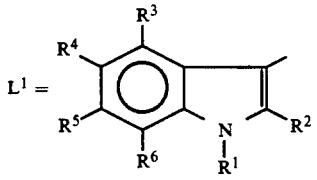

and

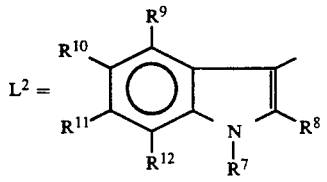

wherein each $X^1$, $X^2$, $X^3$, and $X^4$ is independently selected from chlorine or bromine;

wherein each of $R^1$ and $R^7$ is independently selected from alkyl ($C_1$–$C_8$), aryl, cycloalkyl ($C_3$–$C_6$), alkoxyalkyl or aroxyalkyl;

wherein each of $R^2$ and $R^8$ is independently selected from alkyl ($C_1$–$C_8$) or, aryl, wherein each of $R^3$, $R^4$, $R^5$, $R^6$, $R^9$, $R^{10}$, $R^{11}$, and $R^{12}$ is independently selected from hydrogen, halogen, alkyl ($C_1$–$C_8$), cycloalkyl, aryl, halogen, alkoxy ($C_1$–$C_8$), aroxy, cycloalkoxy, dialkylamino including symmetrical and unsymmetrical alkyl ($C_1$–$C_8$), alkylcycloalkylamino, dicycloalkylamino, alkylarylamino,

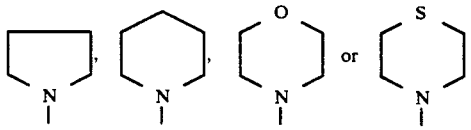

wherein each $L^1$ is the same or different;

wherein each $L^2$ is the same or different with the proviso however that at least one $L^1$ is not identical to at least one $L^2$, the alkyl moieties referred to herein being of one to eight carbons, the cycloalkyl moieties referred to herein being of three to six carbons.

21. The record material according to claim 20 wherein the unsymmetrical chromogenic di-[bis(indolyl)ethylenyl]tetrahalophthalide is

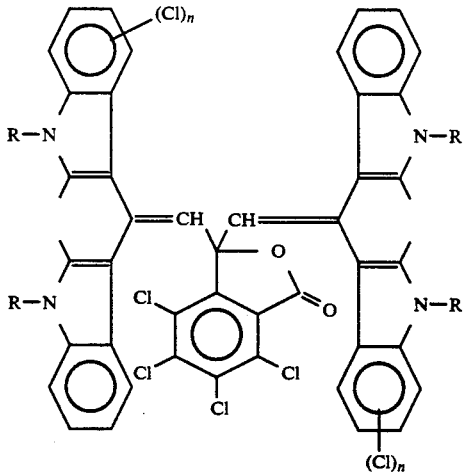

wherein R is an alkyl from one to eight carbons, wherein n is an integer from one to four.

22. The record material according to claim 20 wherein unsymmetrical chromogenic di-[bis(indolyl) ethylenyl]tetrahalophthalide is

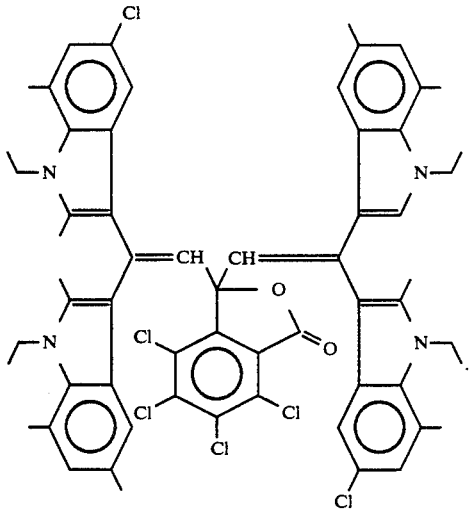

23. The record material according to claim 20 wherein the unsymmetrical chromogenic di-[bis(indolyl) ethylenyl]tetrahalophthalide is

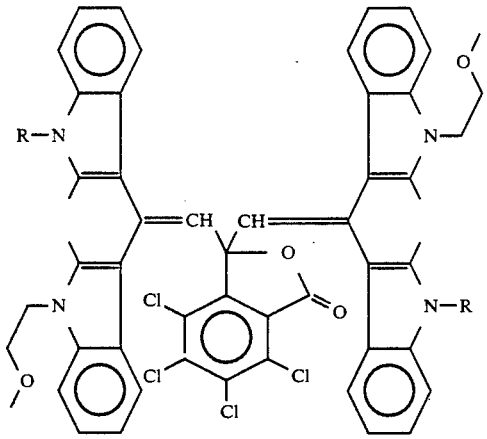

wherein R is an alkyl from one to eight carbons.

24. The record material according to claim 20 wherein unsymmetrical chromogenic di-[bis(indolyl) ethylenyl]tetrahalophthalide is

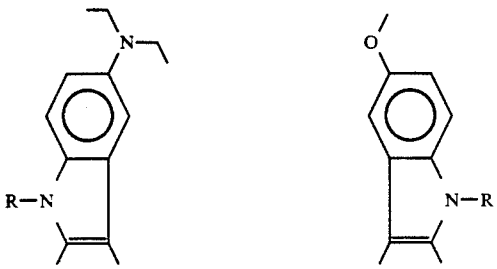

-continued

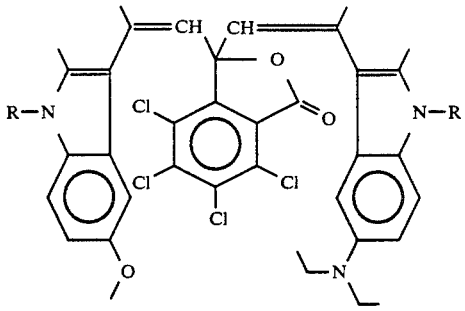

wherein R is an alkyl from one to eight carbons.

25. The record material according to claim 20 wherein unsymmetrical chromogenic di-[bis(indolyl) ethylenyl]tetrahalophthalide is

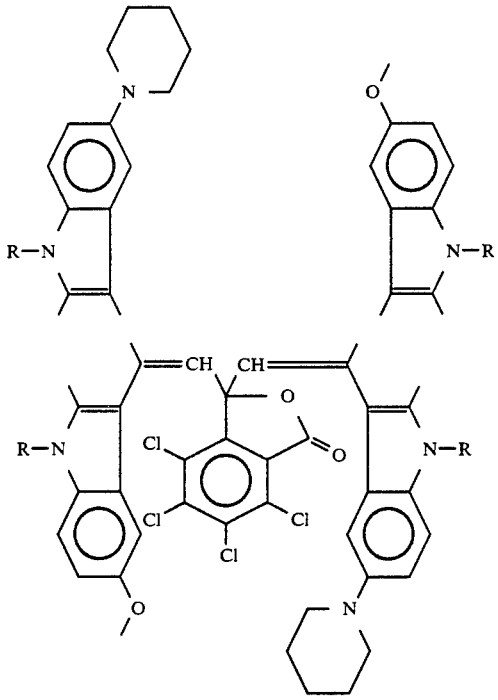

wherein R is an alkyl from one to eight carbons.

26. The record material according to claim 20 wherein unsymmetrical chromogenic di-[bis(indolyl) ethylenyl]tetrahalophthalide is

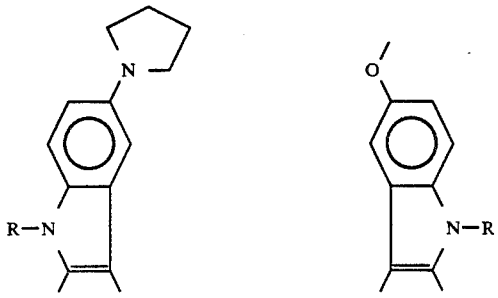

-continued

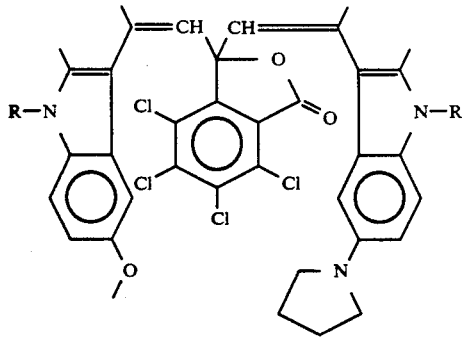

wherein R is an alkyl from one to eight carbons.

27. The record material according to claim 20 wherein unsymmetrical chromogenic di-[bis(indolyl)ethylenyl]tetrahalophthalide is

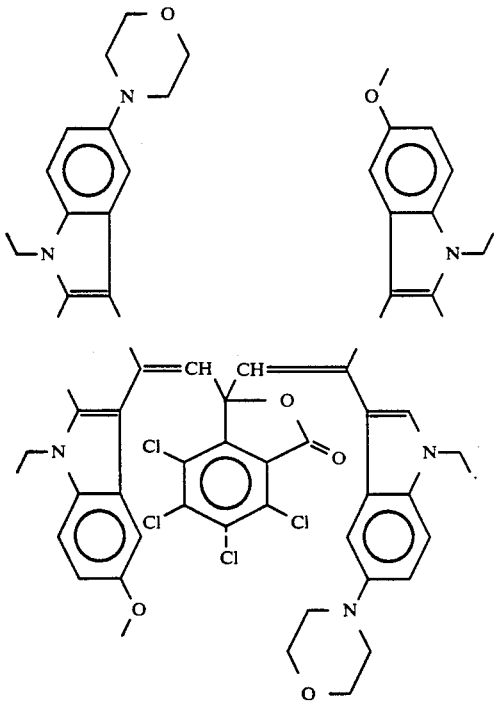

28. The record material according to claim 20 wherein unsymmetrical chromogenic di-[bis(indolyl) ethylenyl]tetrahalophthalide is

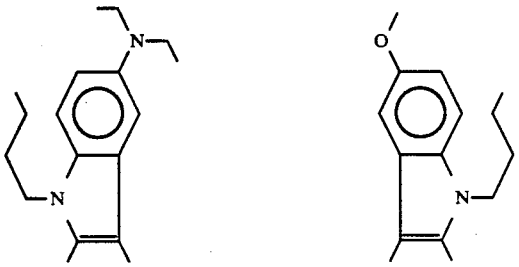

-continued

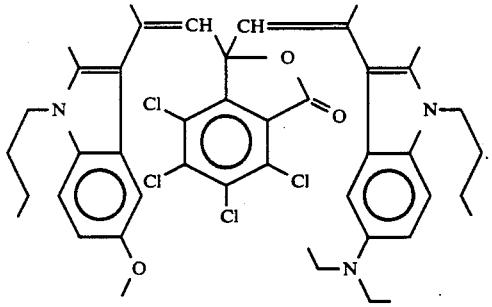

29. The record material according to claim 20 wherein unsymmetrical chromogenic di-[bis(indolyl) ethylenyl]tetrahalophthalide is

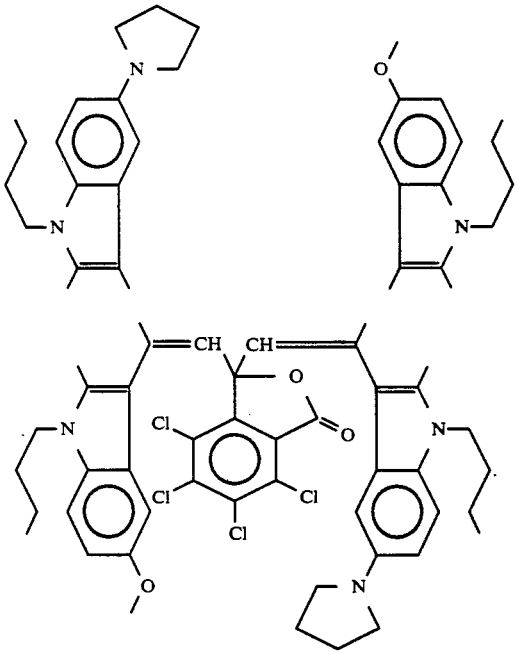

30. The record material according to claim 20 wherein unsymmetrical chromogenic di-[bis(indolyl) ethylenyl]tetrahalophthalide is

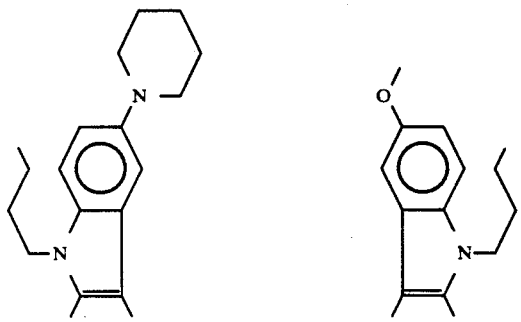

-continued

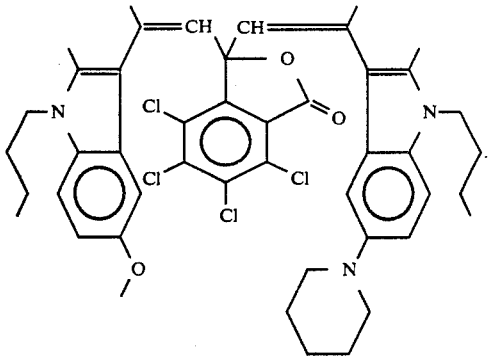

31. The record material according to claim 20 wherein unsymmetrical chromogenic di-[bis-(indolyl) ethylenyl]tetrahalophthalide is

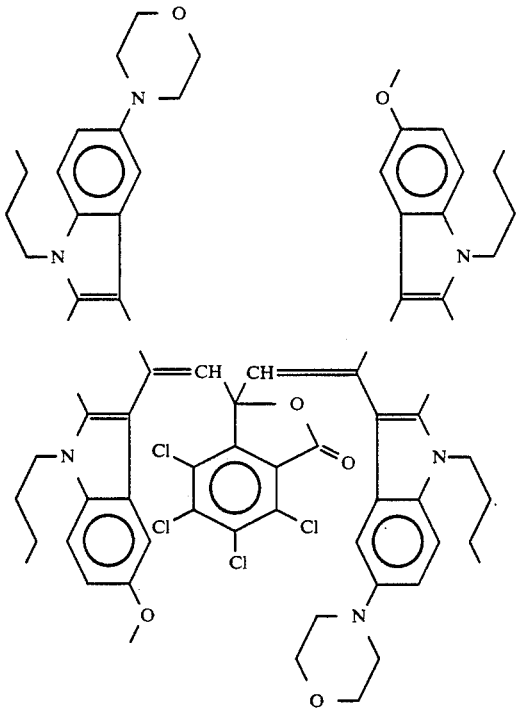

32. The record material according to claim 20 wherein in the chromogenic di-[bis(indolyl)ethylenyl]-tetrahalophthalide in each $R^1$ and $R^7$ independently is alkyl or alkoxyalkyl;

in each $R^2$ and $R^8$ independently is alkyl;

in each of $R^3$, $R^4$, $R^5$, $R^6$, $R^9$, $R^{10}$, $R^{11}$, and $R^{12}$ is independently selected from hydrogen, alkoxy, dialkylamino,

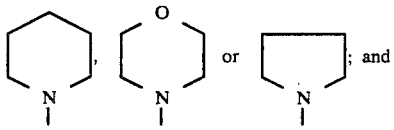

with the proviso that at least one $L^1$ is not identical to at least one $L^2$, each alkyl moiety referred to herein is from one to eight carbons.

33. The record material according to claim 20 wherein in the chromogenic di-[bis(indolyl)ethylenyl]-tetrahalophthalide each of $R^1$ and $R^7$ independently is alkyl or alkoxyalkyl;

each of $R^2$ and $R^8$ independently is alkyl;

each of $R^3$, $R^4$, $R^5$, $R^6$, $R^9$, $R^{10}$, $R^{11}$, and $R^{12}$ is independently selected from hydrogen, alkyl, or halogen;

with the proviso that at least one $L^1$ is not identical to at least one $L^2$.

34. A heat sensitive record material comprising a substrate having coated thereon an acidic developer material, and 3,3-bis[1,1-bis(1-β-methoxyethyl-2-methylindole-3-yl) ethylene-2-yl]-4,5,6,7-tetrachlorophthalide.

35. The record material according to claim 34 including in addition 3-di-n-butylamino-7-(2-chloroanilino) fluoran dye, 2,2-bis-(4-hydroxyphenyl)4-methylpentane as a modifier, and 1,2-diphenoxyethane as a sensitizer.

36. A heat sensitive record material comprising a substrate having coated thereon an acidic developer material and 3,3-bis[1-(1-ethyl-2-methylindole-3-yl)-1-(1-β-methoxyethyl-2-methylindole-3-yl)ethylene-2-yl]-4,5,6,7-tetrachlorophthalide.

37. The record material according to claim 36 including in addition a fluoran dye, 2,2-bis(4-hydroxyphenyl)-4-methylpentane as a modifier, and 1,2-diphenoxyethane as a sensitizer.

* * * * *